US012442548B2

(12) United States Patent
Sawada et al.

(10) Patent No.: US 12,442,548 B2
(45) Date of Patent: Oct. 14, 2025

(54) OUTDOOR UNIT FOR REFRIGERATION CYCLE APPARATUS

(71) Applicant: Mitsubishi Electric Corporation, Tokyo (JP)

(72) Inventors: Kazunari Sawada, Tokyo (JP); Shinichi Uchino, Tokyo (JP); Kentaro Nagaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 121 days.

(21) Appl. No.: 18/558,281

(22) PCT Filed: Jul. 2, 2021

(86) PCT No.: PCT/JP2021/025081

§ 371 (c)(1),
(2) Date: Oct. 31, 2023

(87) PCT Pub. No.: WO2023/276134

PCT Pub. Date: Jan. 5, 2023

(65) Prior Publication Data

US 2024/0219040 A1 Jul. 4, 2024

(51) Int. Cl.
*F24F 1/24* (2011.01)
*F24F 1/22* (2011.01)

(52) U.S. Cl.
CPC . *F24F 1/24* (2013.01); *F24F 1/22* (2013.01)

(58) Field of Classification Search
CPC ..... F24F 1/24; F24F 1/22; F24F 1/46; F24F 1/20; F24F 1/54
USPC ..... 62/259.2
See application file for complete search history.

(56) References Cited

FOREIGN PATENT DOCUMENTS

| | | | | |
|---|---|---|---|---|
| CN | 108386926 | A | | 8/2018 |
| JP | S61-119082 | U | | 7/1986 |
| JP | H04-126932 | A | | 4/1992 |
| JP | H10-220824 | A | | 8/1998 |
| JP | 2010038514 | A | * | 2/2010 |
| JP | 2015-215149 | A | | 12/2015 |

(Continued)

OTHER PUBLICATIONS

Extended European Search Report dated Aug. 1, 2024 issued in corresponding European Patent Application No. 21948438.3.

(Continued)

*Primary Examiner* — Steve S Tanenbaum
(74) *Attorney, Agent, or Firm* — Posz Law Group, PLC

(57) ABSTRACT

An outdoor unit for a refrigeration cycle apparatus includes a casing, an air-sending device configured to generate an airflow, and an electric component box disposed above the air-sending device, and including a bottom plate on which control components are placed. The bottom plate of the electric component box includes an inclined portion on which a first component among the control components is placed and inclined such that an upstream end of the inclined portion in the airflow is positioned above a downstream end of the inclined portion in the airflow. The bottom plate further includes a horizontal portion on which a second component among the control components is placed horizontally extending downstream in the airflow, and having an upstream end in the airflow that is connected to the downstream end of the inclined portion in the airflow.

15 Claims, 47 Drawing Sheets

(56) References Cited

FOREIGN PATENT DOCUMENTS

WO 2013/005810 A1 1/2013

OTHER PUBLICATIONS

International Search Report of the International Searching Authority mailed Sep. 7, 2021 for the corresponding International Application No. PCT/JP2021/025081 (and English translation).

* cited by examiner

OUTDOOR UNIT FOR REFRIGERATION CYCLE APPARATUS

CROSS-REFERENCE TO RELATED APPLICATION

This application is a U.S. National Stage Application of International Application No. PCT/JP2021/025081 filed Jul. 2, 2021, the contents of which are incorporated herein by reference.

TECHNICAL FIELD

The present disclosure relates to an outdoor unit for a refrigeration cycle apparatus including an electric component box.

BACKGROUND

An outdoor unit has, in its casing, an air-sending device chamber in which an air outlet, an air-sending device, and a heat exchanger are disposed in this order from a front side to a rear side. Patent Literature 1 discloses an outdoor unit including an electric component box that houses a control board or electric components. The electric component box is disposed in a space between an air-sending device in an air-sending device chamber and a top panel and above the air-sending device.

The electric component box of Patent Literature 1 is inclined downward toward an air outlet and upward toward a heat exchanger in a direction of a rotation axis of an air-sending fan, and a heat sink having heat dissipation fins projecting outward is attached to the electric component box. That is, the electric component box of Patent Literature 1 is disposed with inclination such that an upstream side of an airflow is above a downstream side of the airflow. Therefore, the airflow having passed through the heat exchanger and through the heat sink is smoothly guided to the air outlet to have a sufficient air speed for cooling of the heat sink.

PATENT LITERATURE

Patent Literature 1: Japanese Unexamined Patent Application Publication No. 2015-215149

Since the cuboid electric component box is inclined in Patent Literature 1, the length of each side of the cuboid electric component box needs to be increased to increase the area of a region including the control board or the electric components without increasing the lateral width of the electric component box. When the cuboid electric component box increased in the length of each side is disposed with inclination such that the upstream side of the airflow is above the downstream side of the airflow, however, the vertical width of the electric component box, in other words, the height of the electric component box also increases in a projection area of the electric component box projected to a plane orthogonal to the airflow. Therefore, the electric component box does not fit in the space above the air-sending device. The projection area of the electric component box projected to the plane orthogonal to the airflow is a projection area of the electric component box viewed from the front of the outdoor unit.

SUMMARY

The present disclosure has been made to solve the problem described above and has an object to provide an outdoor unit for a refrigeration cycle apparatus in which an electric component box having an increased area for disposition of control components can be disposed above an air-sending device without an increase in the vertical width of the electric component box.

An outdoor unit for a refrigeration cycle apparatus according to an embodiment of the present disclosure includes a casing that is an outer shell, an air-sending device housed in the casing and configured to generate an airflow, and an electric component box housed in the casing, disposed above the air-sending device, and including a bottom plate on which control components are placed. The bottom plate of the electric component box includes an inclined portion on which a first component among the control components is placed. The inclined portion is inclined such that an upstream end of the inclined portion on an upstream side of the airflow is positioned above a downstream end of the inclined portion on a downstream side of the airflow. The bottom plate further includes a horizontal portion on which a second component among the control components is placed. The horizontal portion horizontally extends to the downstream side of the airflow and has an upstream end on the upstream side of the airflow that is connected to the downstream end of the inclined portion on the downstream side of the airflow.

In the outdoor unit for the refrigeration cycle apparatus according to an embodiment of the present disclosure, the bottom plate of the electric component box includes the inclined portion of which the upstream side in the airflow is positioned above the downstream side in the airflow, and the horizontal portion horizontally extending from the inclined portion. Therefore, it is possible to provide the outdoor unit for the refrigeration cycle apparatus in which the electric component box having an increased area for disposition of the control components can be disposed above the air-sending device without the increase in the vertical width of the electric component box.

DETAILED DESCRIPTION

Figure 1:
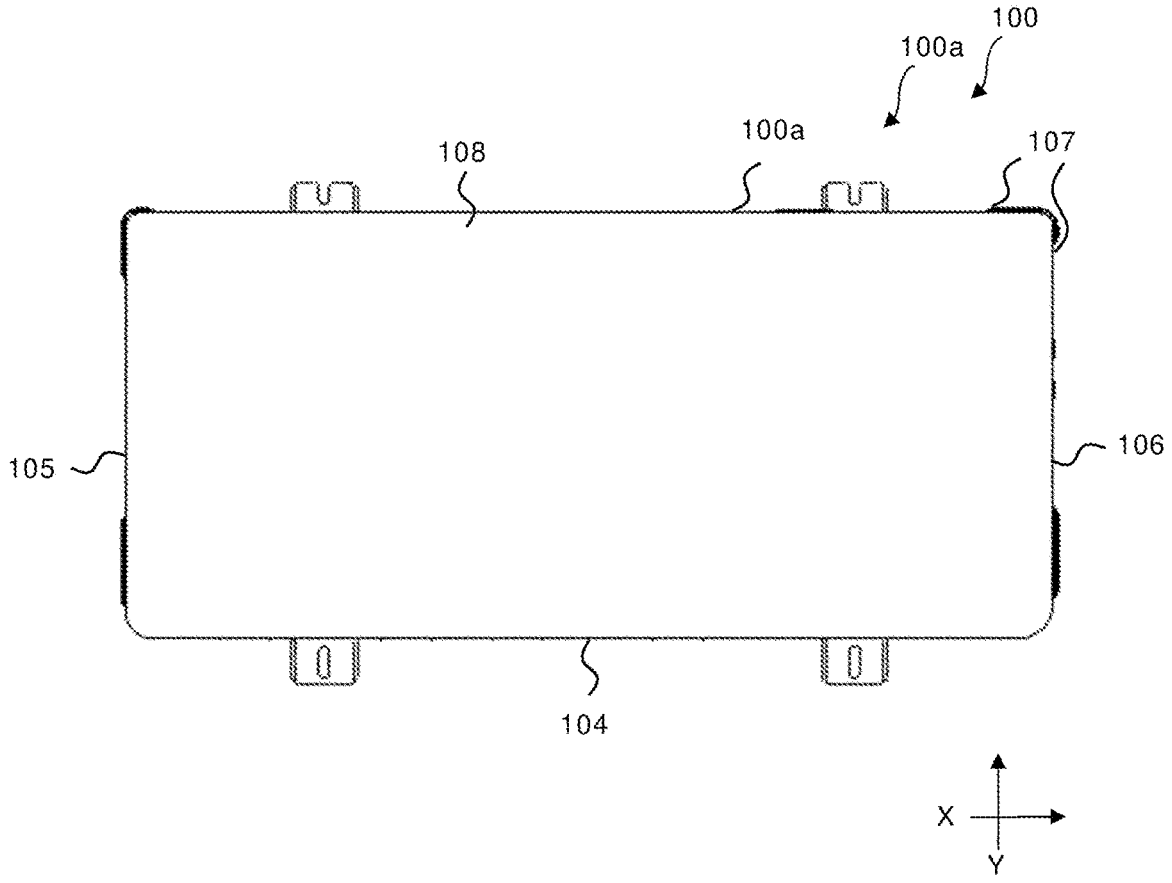
FIG. 1 is a top view of the appearance of an outdoor unit of a refrigeration cycle apparatus according to Embodiment.

An outdoor unit 100 of a refrigeration cycle apparatus according to Embodiment is described below with reference to the drawings. In the drawings to which reference is made below, the relative relationship of dimensions of constituent elements and the shapes of constituent elements may differ from an actual relationship and actual shapes. In the drawings to which reference is made below, elements represented by the same reference signs are identical or corresponding elements and are common throughout the description herein. Alphabets suffixed to numerals in the reference signs in the drawings may be omitted in the description. Terms of directions such as "up", "down", "right", "left", "front", and "rear" are used as appropriate for facilitating understanding. The terms of directions are used only for convenience of the description but do not limit dispositions and directions of devices or components. In the following description, an arrow X represents a direction from left to right, an arrow Y represents a direction from front to rear, and an arrow Z represents a direction from bottom to top.

<Structure of Outdoor Unit>

Figure 2:
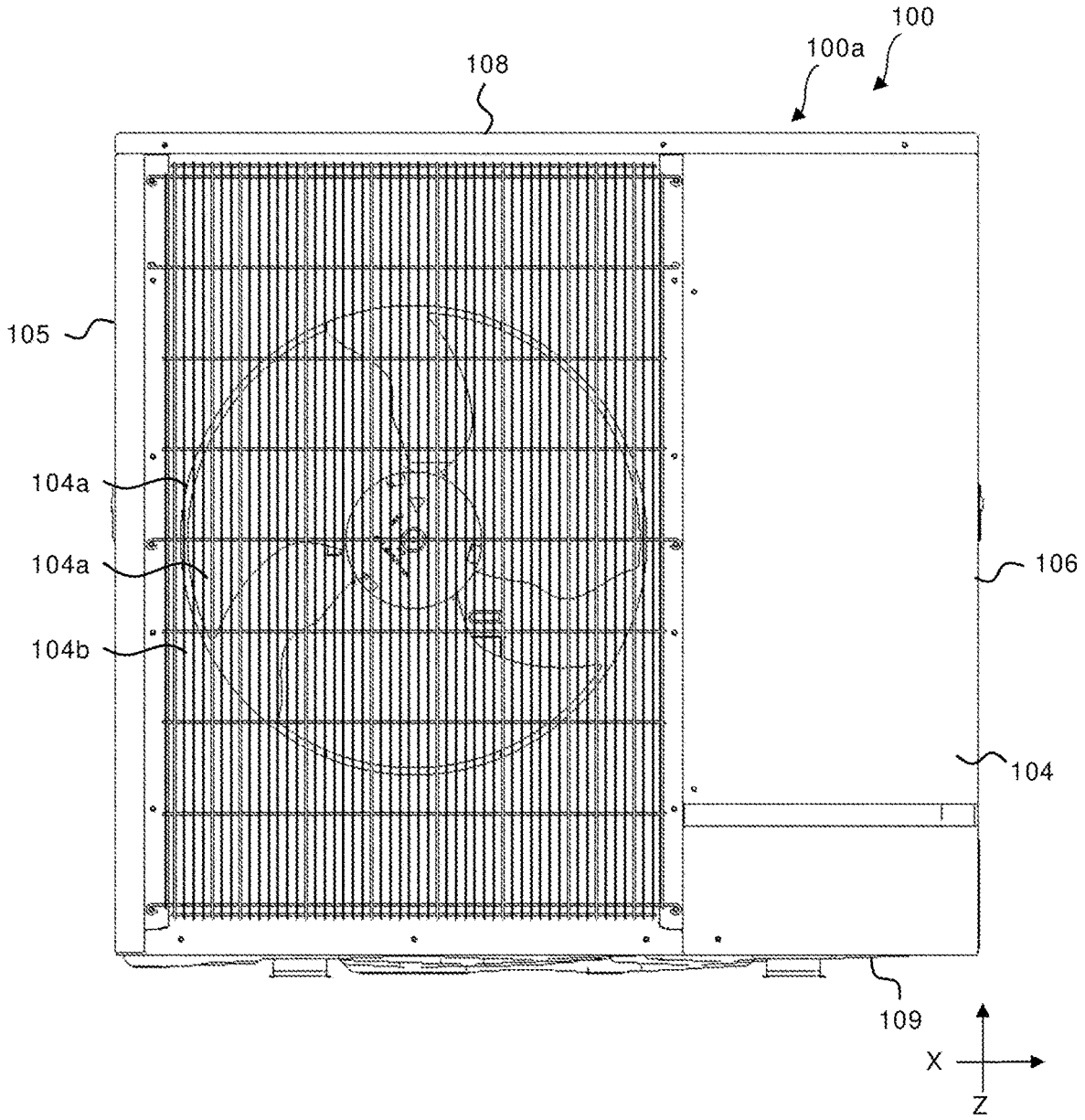
FIG. 2 is a front view of the appearance of the outdoor unit of the refrigeration cycle apparatus according to Embodiment.
Figure 3:
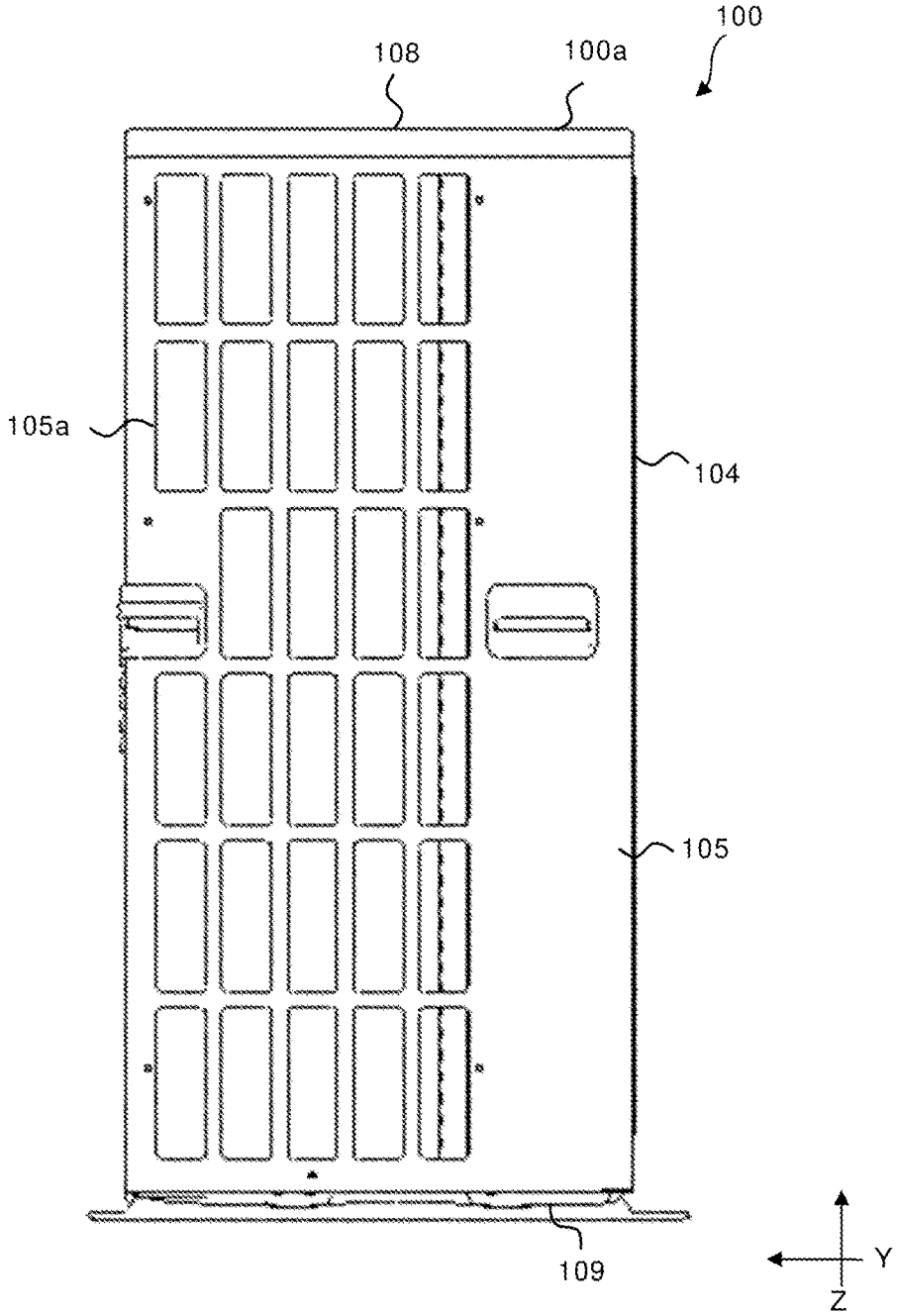
FIG. 3 is a right side view of the appearance of the outdoor unit of the refrigeration cycle apparatus according to Embodiment.
Figure 4:
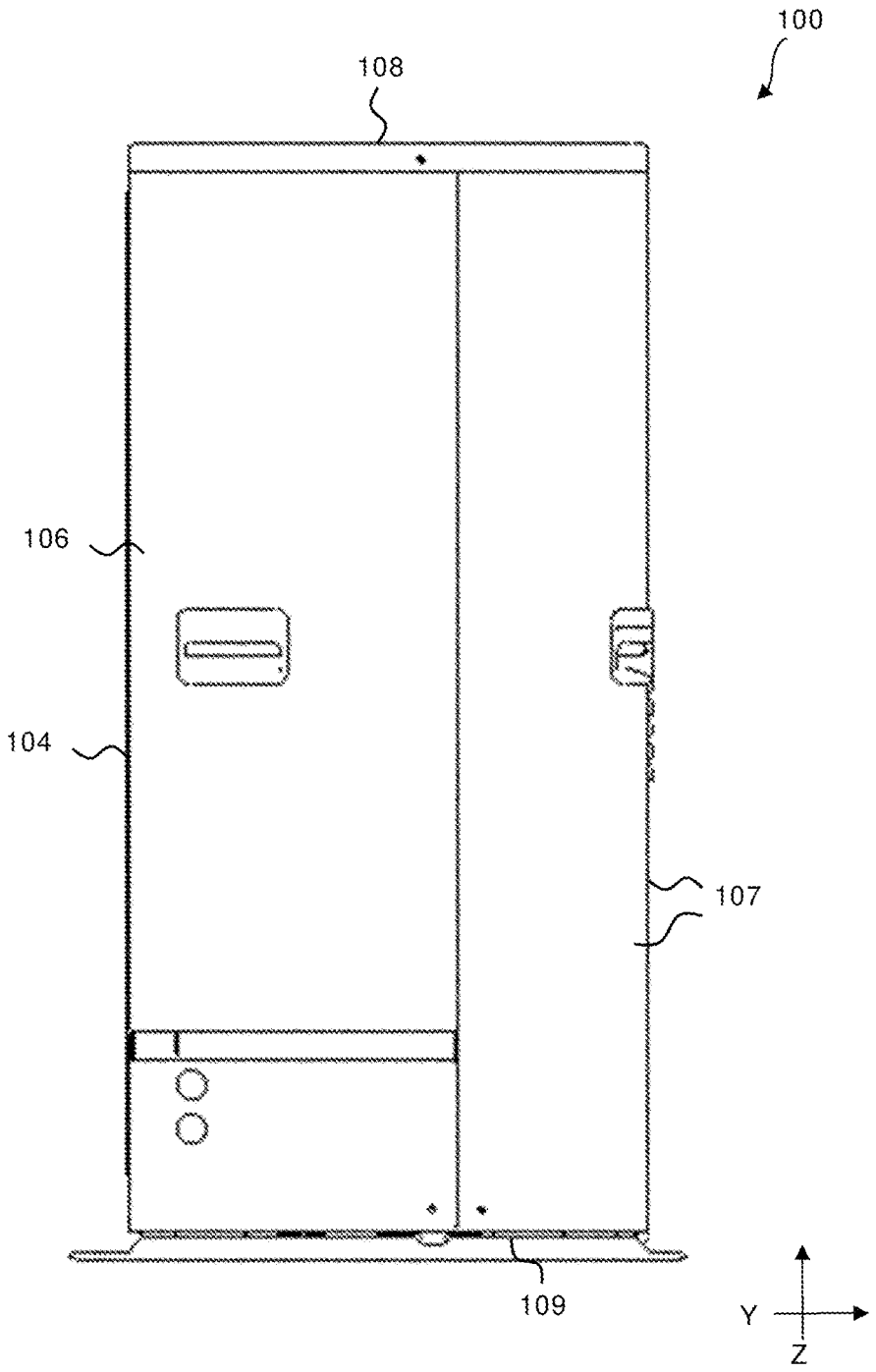
FIG. 4 is a left side view of the appearance of the outdoor unit of the refrigeration cycle apparatus according to Embodiment.

FIG. 1 is a top view of the appearance of the outdoor unit 100 of the refrigeration cycle apparatus according to Embodiment. FIG. 2 is a front view of the appearance of the outdoor unit 100 of the refrigeration cycle apparatus according to Embodiment. FIG. 3 is a right side view of the appearance of the outdoor unit 100 of the refrigeration cycle apparatus according to Embodiment. FIG. 4 is a left side view of the appearance of the outdoor unit 100 of the refrigeration cycle apparatus according to Embodiment. Examples of the refrigeration cycle apparatus include an air-conditioning apparatus.

As illustrated in FIG. 1, FIG. 2, FIG. 3, and FIG. 4, the outdoor unit 100 of the refrigeration cycle apparatus includes a casing 100*a*, which is an outer shell of the outdoor unit 100. The casing 100*a* includes a front panel 104, a left panel 105, a right panel 106, a rear panel 107, a top panel 108, and a bottom panel 109. The front panel 104 serves as the front surface of the outdoor unit 100. The front panel 104 has an air outlet 104*a*. An air-sending device 2 faces the air outlet 104*a*. A fan guard 104*b*, which covers the air outlet 104*a* from the outside, is attached to the front panel 104.

The left panel 105 serves as the left surface of the outdoor unit 100. The left panel 105 has an air inlet 105*a* through which outside air enters the casing 100*a*. The rear panel 107 serves as a right part of the rear surface of the outdoor unit 100 and a rear part of the right surface of the outdoor unit 100. That is, the rear panel 107 has an L-shape in top view. The right panel 106 serves as a front part of the right surface of the outdoor unit 100. The right panel 106 may be, for example, a service panel detachable at its lower part. The left panel 105 and the right panel 106 may have, for example, handles to be held by hands when the outdoor unit 100 is carried.

The top panel 108 is placed on the front panel 104, the left panel 105, the right panel 106, and the rear panel 107. The bottom panel 109 faces the top panel 108 and is disposed parallel to the top panel 108. The front panel 104, the left panel 105, the right panel 106, and the rear panel 107 are fixed to the bottom panel 109.

<Inside of Outdoor Unit>

Figure 5:
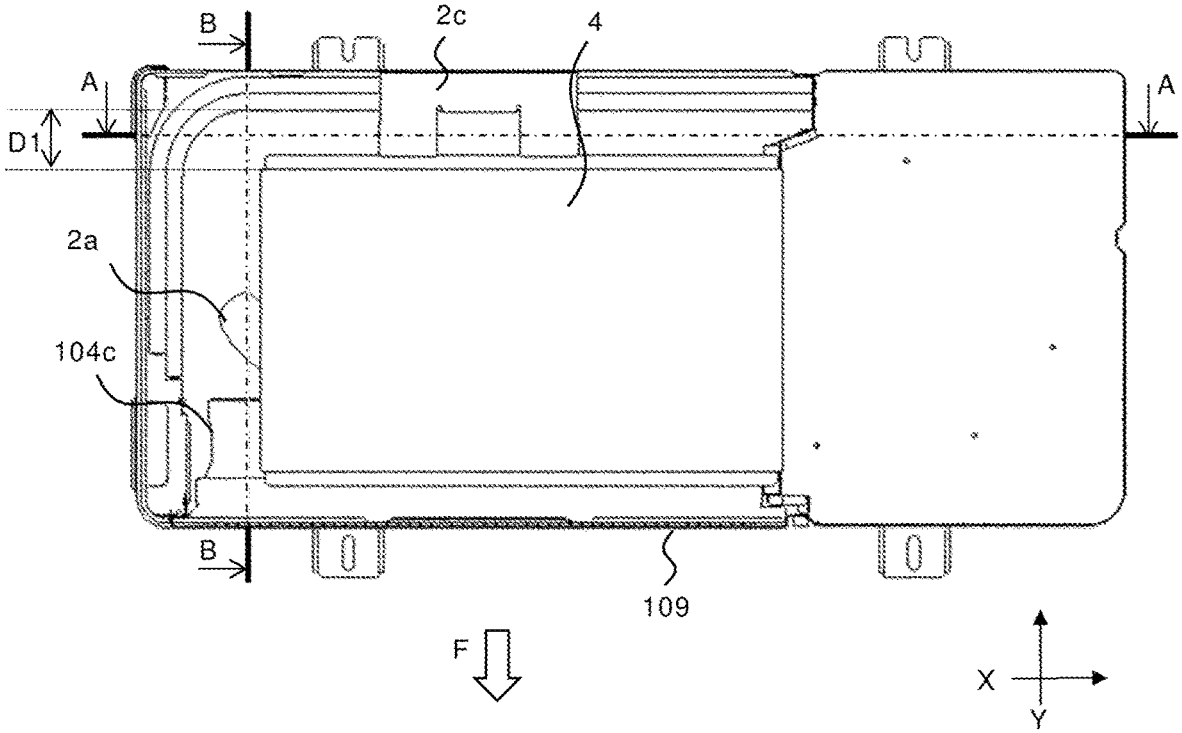
FIG. 5 is a top view of the internal structure of the outdoor unit of the refrigeration cycle apparatus according to Embodiment.
Figure 6:
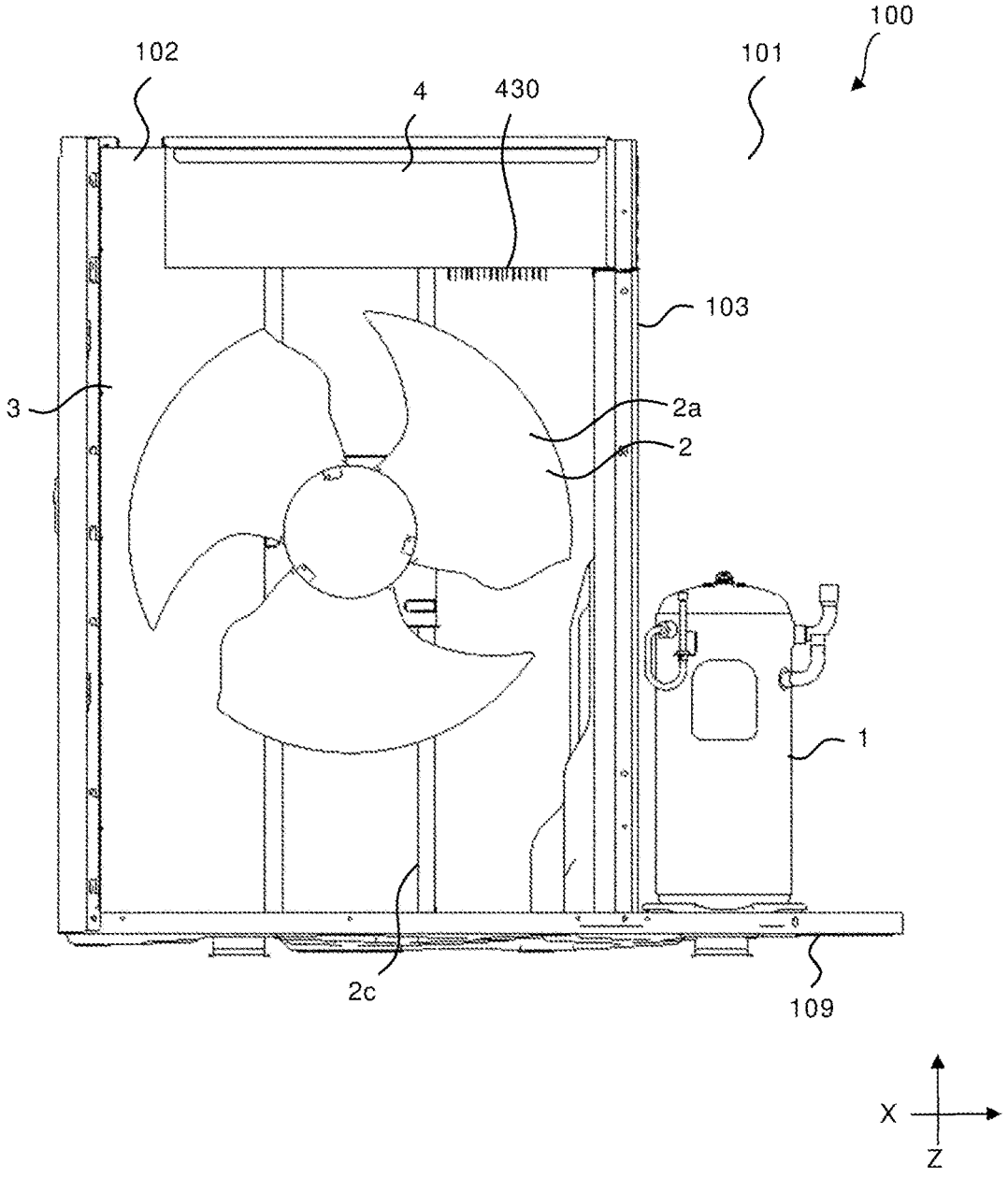
FIG. 6 is a front view of the internal structure of the outdoor unit of the refrigeration cycle apparatus according to Embodiment.
Figure 7:
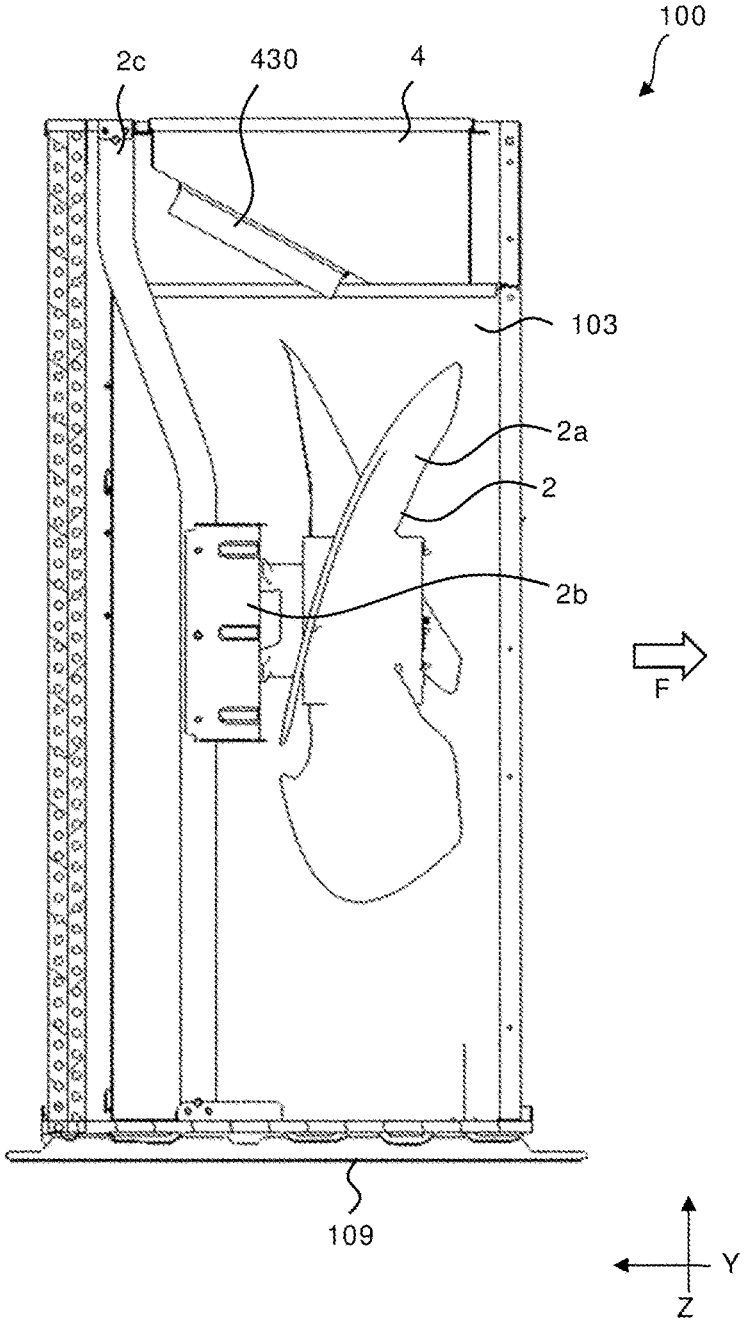
FIG. 7 is a side view of the internal structure of the outdoor unit of the refrigeration cycle apparatus according to Embodiment.
Figure 8:
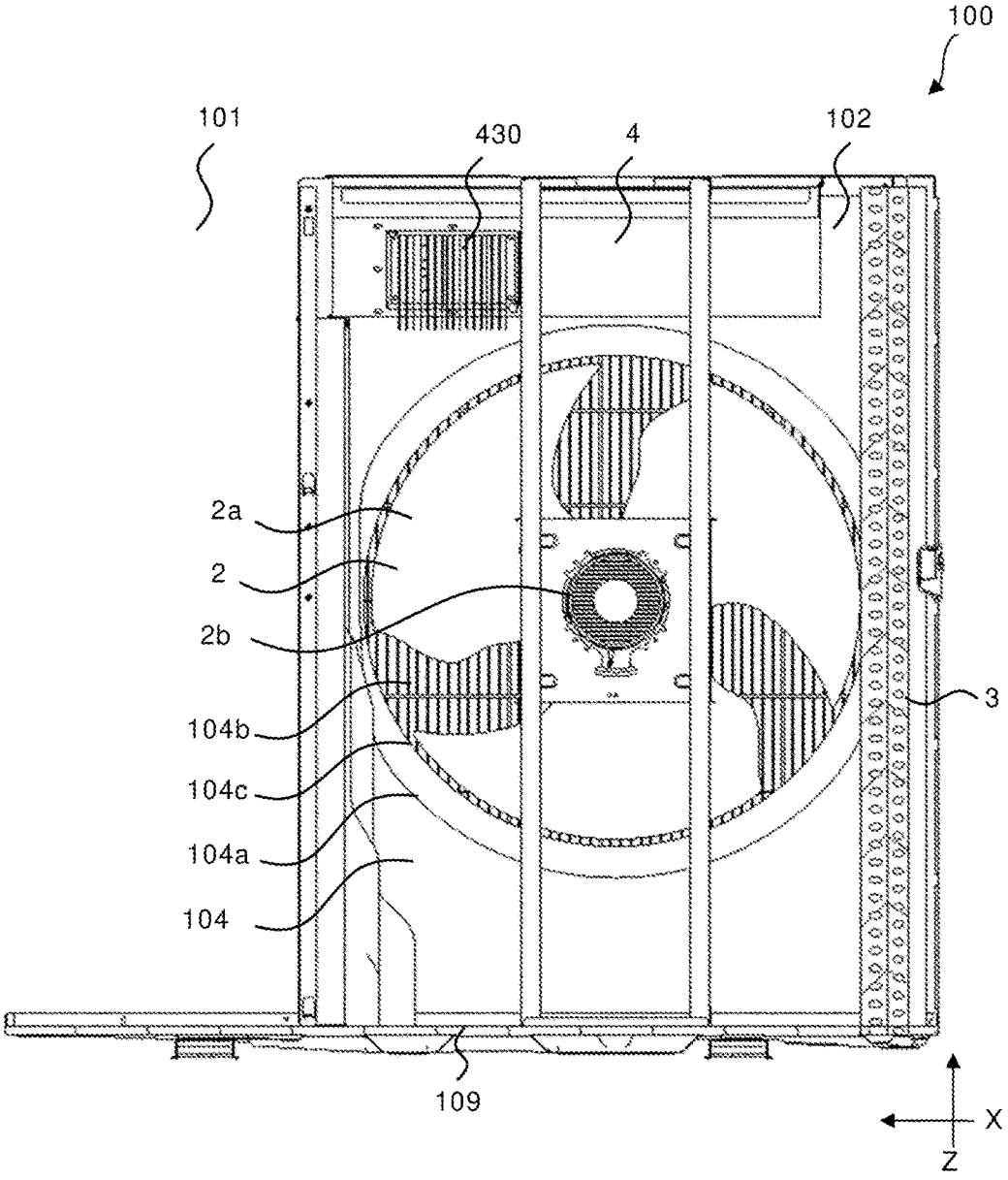
FIG. 8 is a rear view of the internal structure of the outdoor unit of the refrigeration cycle apparatus according to Embodiment.
Figure 9:
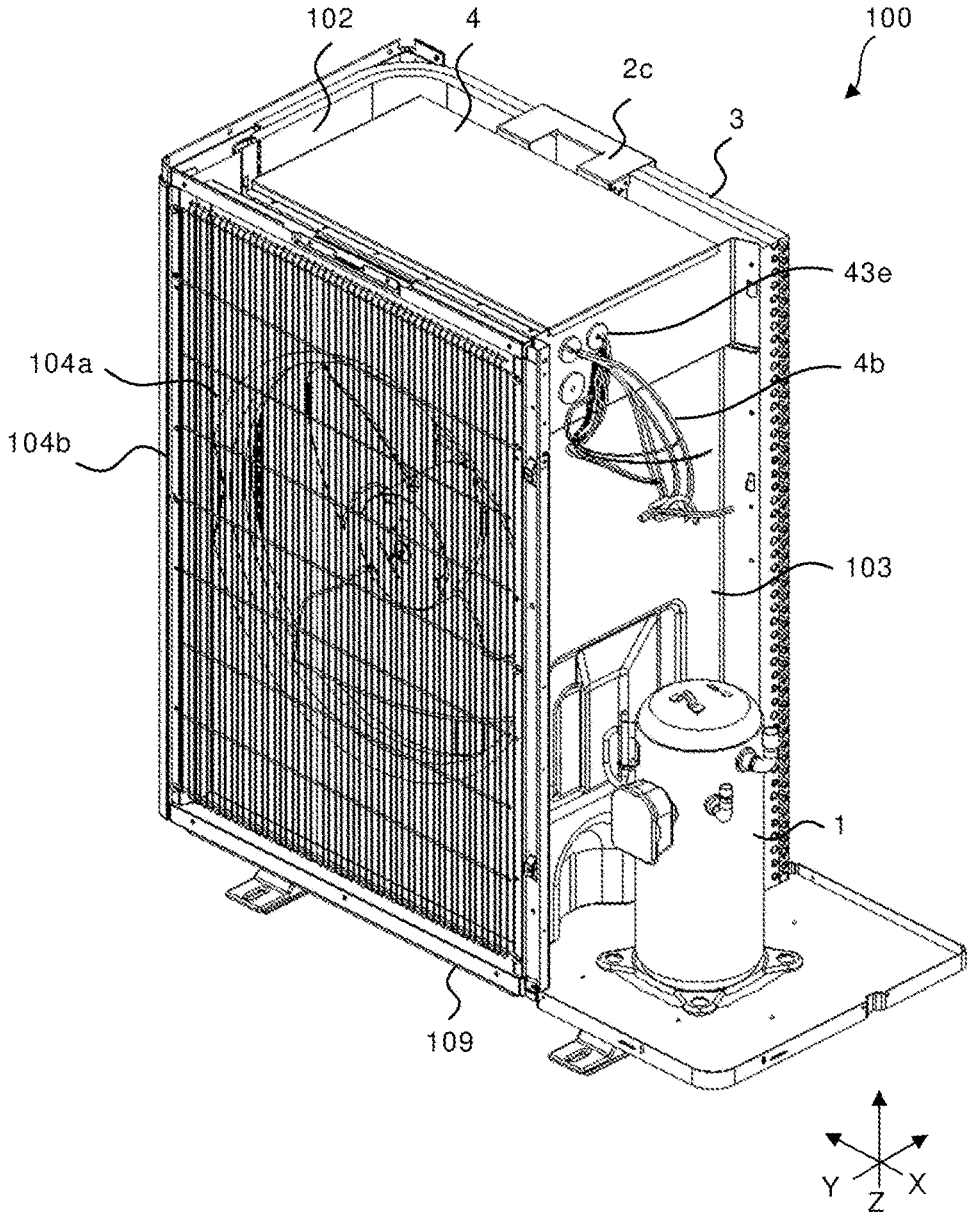
FIG. 9 is a perspective view illustrating the internal structure of the outdoor unit of the refrigeration cycle apparatus according to Embodiment.

FIG. 5 is a top view of the internal structure of the outdoor unit 100 of the refrigeration cycle apparatus according to Embodiment. FIG. 6 is a front view of the internal structure of the outdoor unit 100 of the refrigeration cycle apparatus according to Embodiment, and is a schematic diagram illustrating the inside of the outdoor unit 100. FIG. 7 is a side view of the internal structure of the outdoor unit 100 of the refrigeration cycle apparatus according to Embodiment, and is a schematic diagram illustrating the inside of the outdoor unit 100 when a plane along the line BB in FIG. 5 is viewed in a direction of arrows. FIG. 8 is a rear view of the internal structure of the outdoor unit 100 of the refrigeration cycle apparatus according to Embodiment, and is a schematic diagram illustrating the inside of the outdoor unit 100 when a plane along the line AA in FIG. 5 is viewed in a direction of arrows. FIG. 9 is a perspective view illustrating the internal structure of the outdoor unit 100 of the refrigeration cycle apparatus according to Embodiment.

As illustrated in FIG. 5 to FIG. 9, the casing 100*a* of the outdoor unit 100 is partitioned into a machine chamber 101 and an air-sending device chamber 102 in a lateral direction. A compressor 1 is disposed in the machine chamber 101. The air-sending device 2, a heat exchanger 3, and an electric component box 4 are disposed in the air-sending device chamber 102. The inside of the casing 100*a* is partitioned into the machine chamber 101 and the air-sending device chamber 102 by a partition plate 103 disposed on the top of the bottom panel 109 and a first side plate 43 serving as the side surface of the electric component box 4 that faces the machine chamber 101. The electric component box 4 is positioned above the partition plate 103. The first side plate 43 is described later in detail.

The compressor 1 housed in the machine chamber 101 is, for example, a compressor capable of controlling the capacity by inverter control drive, and compresses sucked refrigerant into high-temperature and high-pressure gas refrigerant and discharges the refrigerant. Although refrigerant pipes, an expansion valve, and other devices included in a refrigeration cycle are also housed in the machine chamber 101, illustration of these devices is omitted herein.

The air-sending device 2 housed in the air-sending device chamber 102 includes a propeller fan 2*a* and a motor 2*b*. The motor 2*b* of the air-sending device 2 is fixed to a motor support 2*c*, which extends upward from the bottom panel 109, and is positioned behind the air-sending device 2. The air-sending device 2 generates an airflow F so that heat is exchanged efficiently. The axis of the air-sending device 2 is along a front-and-rear direction of the casing 100*a*. The air-sending device 2 guides air from the outside (outside air) into the air-sending device chamber 102 and sends the air forward from the outdoor unit 100. The air sent by the air-sending device 2 passes through a bell mouth 104*c* of the front panel 104 and is discharged to the outside of the casing 100*a* through the air outlet 104*a*.

The heat exchanger 3 exchanges heat between the outside air and the refrigerant, and serves as an evaporator during a heating operation and as a condenser during a cooling operation. The heat exchanger 3 includes, for example, unillustrated heat transfer tubes through which the refrigerant passes, and unillustrated heat dissipation fins that increase the heat transfer area between the refrigerant in the heat transfer tubes and the outside air. In top view, the heat exchanger 3 has, for example, an L-shape with a flat region including a long part and a short part and a curved region connecting the long part and the short part. In the heat exchanger 3, the long part of the flat region is disposed at the rear of the air-sending device chamber 102, and the short part of the flat region is disposed at the side of the air-sending device chamber 102 opposite to the machine chamber 101. The heat exchanger 3 serves as a part of the rear surface of the casing 100*a*. The heat exchanger 3 may serve as a left surface of the casing 100*a*. In this case, the casing 100*a* does not have to have the left panel 105.

Although the heat exchanger 3 has the L-shape in this example, the heat exchanger 3 may have an I-shape in top view with only the long part of the flat region or a U-shape in top view with two curved regions. When the air-sending device 2 is driven, the outside air is guided into the air-sending device chamber 102 of the outdoor unit 100 and passes through the heat exchanger 3 at this time.

The electric component box 4 is disposed above the air-sending device 2. The electric component box 4 is disposed between the air-sending device 2 and the top panel 108. The phrase "above the air-sending device 2" refers to a space between the air-sending device 2 and the top panel 108, and more specifically, a space between the propeller fan 2*a* and the top panel 108. The electric component box 4 is disposed such that the electric component box 4 faces an upper part of the heat exchanger 3 in a horizontal direction. A heat sink 430 projects from the electric component box 4. The air guided into the outdoor unit 100 by the drive of the air-sending device 2 passes through the heat sink 430. The heat sink 430 transfers heat to the air guided into the air-sending device chamber 102.

As illustrated in FIG. 5, the electric component box 4 and the upper part of the heat exchanger 3 maintain, in top view, a predetermined distance D1 from each other. The distance D1 is a distance at which the airflow F is not obstructed. In top view, the electric component box 4 and the upper part of the heat exchanger 3 maintain the predetermined distance D1 from each other. The predetermined distance D1 is, for example, larger than the thickness of the heat exchanger 3. When the thickness of the heat exchanger 3 is, for example, 40 mm, the predetermined distance D1 is, for example, 50 mm. Even in the curved region connecting the long part and the short part of the heat exchanger 3, the electric component box 4 is disposed at a distance larger than or equal to the predetermined distance D1 at which the airflow F is not obstructed. Therefore, there is no such case that the airflow F does not pass through the upper part of the heat exchanger 3, which faces the electric component box 4. Thus, a decrease in the heat exchange capacity due to the presence of the electric component box 4 can be prevented or reduced.

The electric component box 4 houses control components that control operations of the outdoor unit 100 including an operation of the compressor 1 or the air-sending device 2. The control components include a heat generating component. Examples of the control components include a controller formed by hardware such as a circuit device that implements a function to control the operations of the outdoor unit 100, software to be executed on an arithmetic device such as a microcomputer and a central processing unit, or a combination of hardware and software. The electric component box 4 has electric wire passing ports 43*e* (see FIG. 9). By electric wires 4*b* extending through the electric wire passing ports 43*e*, the control components in the electric component box 4 are connected to constituent elements such as the compressor 1 housed in the machine chamber 101.

The electric component box 4 houses a control component that may be a cause of firing. In a case where flammable refrigerant is used as the refrigerant of the refrigeration cycle apparatus, it is desirable to, when refrigerant gas leaks, eliminate the possibility that the refrigerant gas having leaked flows into the electric component box 4.

The refrigerant may leak in the machine chamber 101 including a plurality of connection portions of the refrigerant pipes compared with the air-sending device chamber 102. In the outdoor unit 100, however, the electric component box 4 is disposed in the air-sending device chamber 102 and separated from the machine chamber 101 by the partition plate 103. Since the refrigerant gas has a greater specific gravity than air, the refrigerant gas that leaks in the machine chamber 101 flows downward in the machine chamber 101. However, the electric component box 4 is disposed above the air-sending device chamber 102. Therefore, the possibility that refrigerant gas having leaked flows into the electric component box 4 can be reduced.

<Operations of Outdoor Unit 100>

In the refrigeration cycle apparatus according to Embodiment, nonflammable or flammable refrigerant is used as the refrigerant. R290 (propane) may be used as the flammable refrigerant. The air-conditioning apparatus, which is the refrigeration cycle apparatus, performs a heating operation and a cooling operation under control of the controller.

During the cooling operation, the refrigerant is compressed into high-temperature and high-pressure gas refrigerant and discharged by the compressor 1 housed in the outdoor unit 100. The refrigerant discharged from the compressor 1 flows into the heat exchanger 3, which serves as the condenser, exchanges heat with air passing through the heat exchanger 3 to turn into high-pressure liquid refrigerant, and flows out of the heat exchanger 3. The pressure of the high-pressure liquid refrigerant having flowed out of the heat exchanger 3 is reduced by the unillustrated expansion valve so that the refrigerant turns into low-pressure two-phase gas-liquid refrigerant. The refrigerant flows into an unillustrated indoor unit from the outdoor unit 100. The two-phase gas-liquid refrigerant is evaporated into gas refrigerant by receiving heat from indoor air at a heat exchanger of the indoor unit. The refrigerant is sucked into the compressor 1 of the outdoor unit 100 again.

During the heating operation, the refrigerant is compressed into high-temperature and high-pressure gas refrigerant and discharged by the compressor 1. The refrigerant flows into the unillustrated indoor unit from the outdoor unit 100, and transfers heat to indoor air at the heat exchanger of the indoor unit to turn into high-pressure liquid refrigerant. The pressure of the high-pressure liquid refrigerant is reduced by the unillustrated expansion valve of the outdoor unit 100 so that the refrigerant turns into low-pressure two-phase gas-liquid refrigerant. The refrigerant exchanges heat with outside air at the heat exchanger 3, which serves as the evaporator, to turn into low-temperature and low-pressure gas refrigerant. The refrigerant is sucked into the compressor 1 again.

<Structure of Electric Component Box 4>

Figure 10:
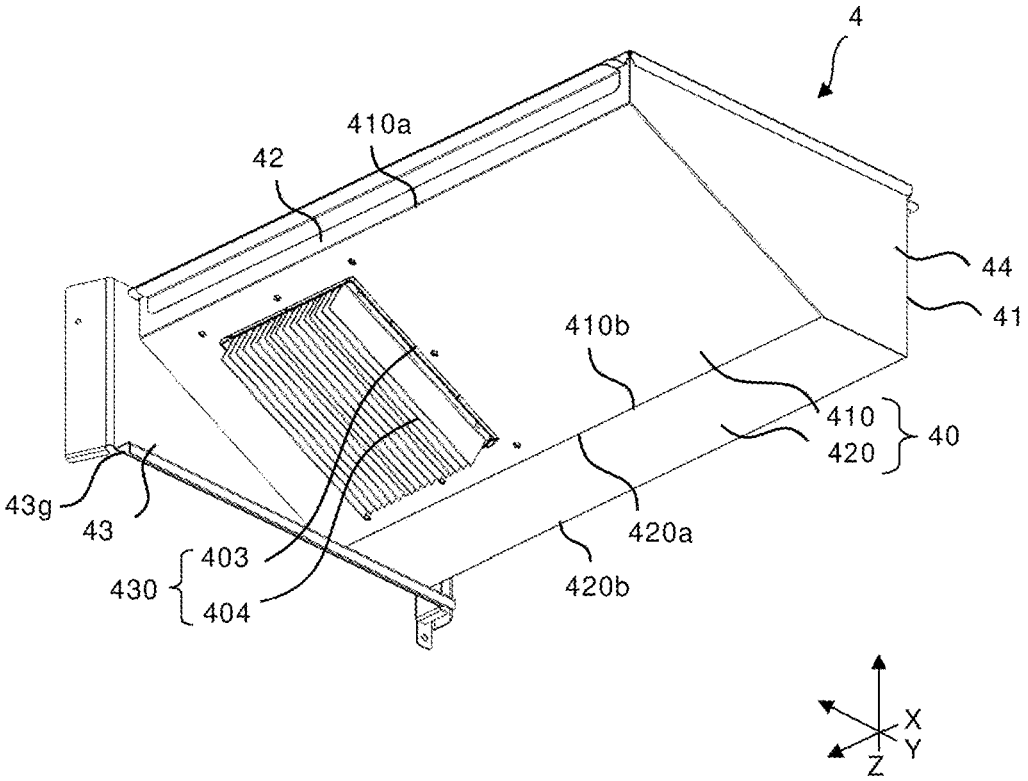
FIG. 10 is a perspective view of an electric component box of the outdoor unit of the refrigeration cycle apparatus according to Embodiment.

FIG. 10 is a perspective view of the electric component box 4 of the outdoor unit 100 of the refrigeration cycle apparatus according to Embodiment. As illustrated in FIG. 10, the electric component box 4 includes a bottom plate 40, a front plate 41, a rear plate 42, the first side plate 43, and a second side plate 44. The bottom plate 40 includes an inclined portion 410 and a horizontal portion 420. In the electric component box 4, the right surface, that is, the second side plate 44 has a pentagonal shape. The electric component box 4 is made of a metal sheet component.

The inclined portion 410 is inclined such that, when the electric component box 4 is attached to the outdoor unit 100, an upstream end 410*a* on an upstream side of the airflow F (see FIG. 7) is positioned above a downstream end 410*b* on a downstream side of the airflow F. With the bottom plate 40 including the inclined portion 410, the airflow F having passed through the heat exchanger 3 disposed further upstream in the airflow F than the electric component box 4 is smoothly guided to the air outlet 104*a* disposed further downstream in the airflow F than the electric component box 4.

When the electric component box 4 is attached to the outdoor unit 100, an upstream end 420*a* of the horizontal portion 420 on the upstream side of the airflow F is connected to the downstream end 410*b* of the inclined portion 410, and the horizontal portion 420 extends horizontally downstream to a downstream end 420*b*. The horizontal portion 420 is disposed such that, when the electric component box 4 is attached to the outdoor unit 100, the height positions of the upstream end 420*a* on the upstream side of the airflow F and the downstream end 420*b* on the downstream side of the airflow F are aligned horizontally. The horizontal portion 420 is parallel to the bottom panel 109 of the outdoor unit 100. The horizontal portion 420 does not have to be strictly horizontal, and the horizontal portion 420 and the bottom panel 109 of the outdoor unit 100 does not have to be strictly parallel to each other.

The heat sink 430 is disposed on the inclined portion 410. The heat sink 430 cools the control components such as the controller housed in the electric component box 4. The heat sink 430 includes a base plate 403 and a plurality of fins 404 extending along the airflow F on the base plate 403. The plurality of fins 404 of the heat sink 430 projects to the outside of the electric component box 4 through a bottom opening 411 described later in the inclined portion 410. With the heat sink 430 disposed on the inclined portion 410, the airflow F having passed through the heat exchanger 3 passes between the plurality of fins 404 arranged side by side in the heat sink 430 without a decrease in the air speed. Therefore, the control component cooling effect of the heat sink 430 is improved.

Since the bottom plate 40 of the electric component box 4 includes the inclined portion 410 and the horizontal portion 420 and the right surface, which is the second side plate 44, has the pentagonal shape, the surface area of the bottom plate 40 of the electric component box 4 can be increased while the vertical width of the electric component box 4 is maintained compared with a case where the related-art cuboid electric component box is inclined. Therefore, the area for disposition of the control components is increased in the electric component box 4 compared with the case where the cuboid electric component box is inclined.

<Internal Structure of Electric Component Box 4>

Figure 11:
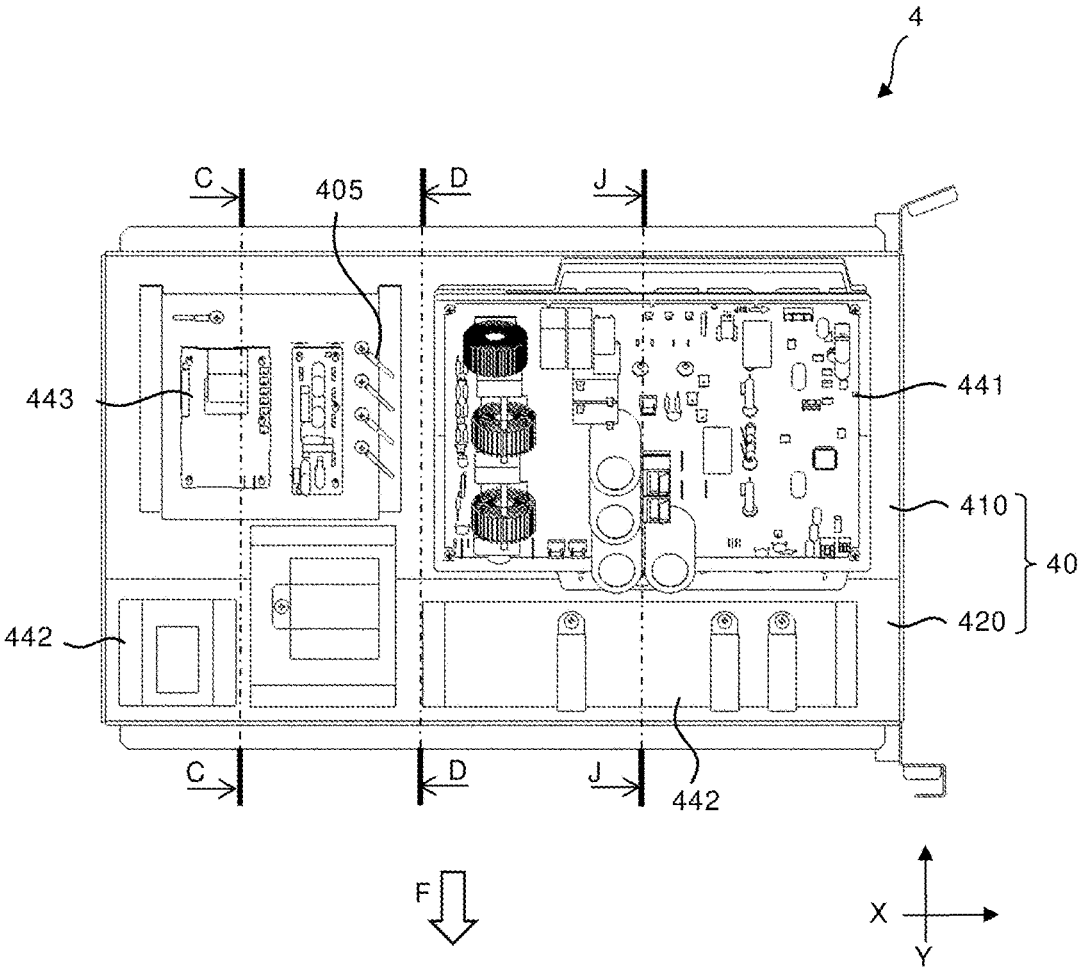
FIG. 11 is a diagram illustrating the internal structure of the electric component box of the outdoor unit of the refrigeration cycle apparatus according to Embodiment.

FIG. 11 is a diagram illustrating the internal structure of the electric component box 4 of the outdoor unit 100 of the refrigeration cycle apparatus according to Embodiment. As illustrated in FIG. 11, the control components housed in the electric component box 4 are, for example, a control board 441, electric components 442, and an electrical board 443, which is different from the control board 441. The control board 441 is disposed on the inclined portion 410. An electric component 442 or an electrical board 443 may be disposed on the inclined portion 410. A plurality of ground terminals 405 may be connected to the inclined portion 410. The control board 441 is an example of a first component.

The electric components 442 or the electrical board 443 different from the control board 441 is disposed on the horizontal portion 420. For example, a capacitor can be mounted on the horizontal portion 420 as the electric component 442. The electric component 442 to be used with limitation when the electric component 442 is inclined can be disposed on the horizontal portion 420. The electric components 442 and the electrical board 443 are placed on a mount component 444 and a connection component 445 (see FIG. 15). The electric components 442 or the electrical board 443 different from the control board 441 is an example of a second component.

With the bottom plate 40 including the horizontal portion 420, the vertical width is reduced and the area of the disposition region of the electrical board 443 or the electric components 442 is increased. Further, the electric component 442 to be used with limitation when the electric component 442 is inclined can be disposed.

<Outer Shell of Electric Component Box 4>

Figure 12:
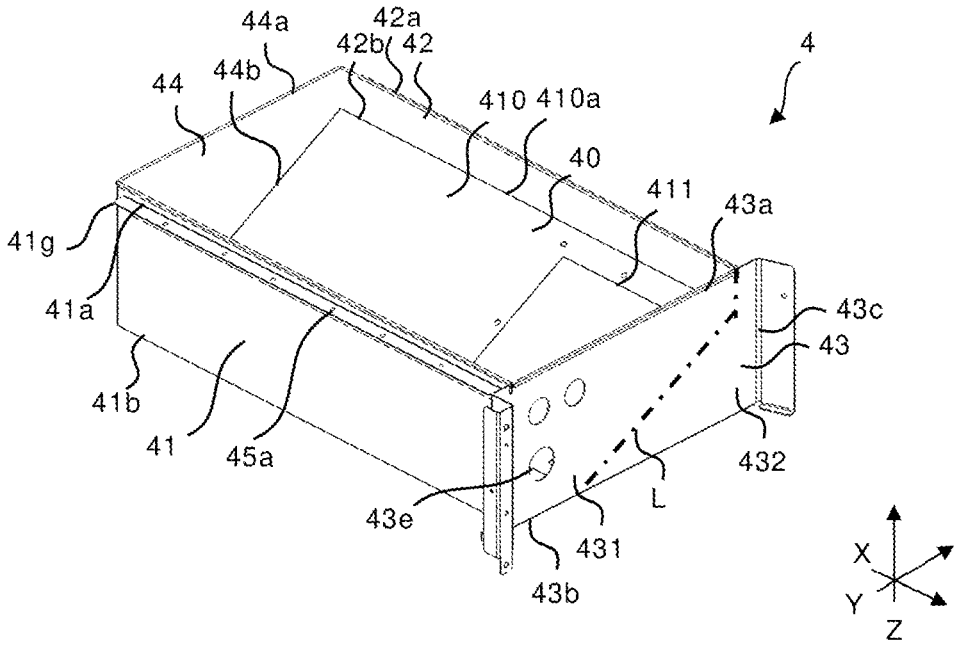
FIG. 12 is a perspective view of the appearance of the electric component box of the outdoor unit of the refrigeration cycle apparatus according to Embodiment when the right front of the electric component box is viewed from the top.
Figure 13:
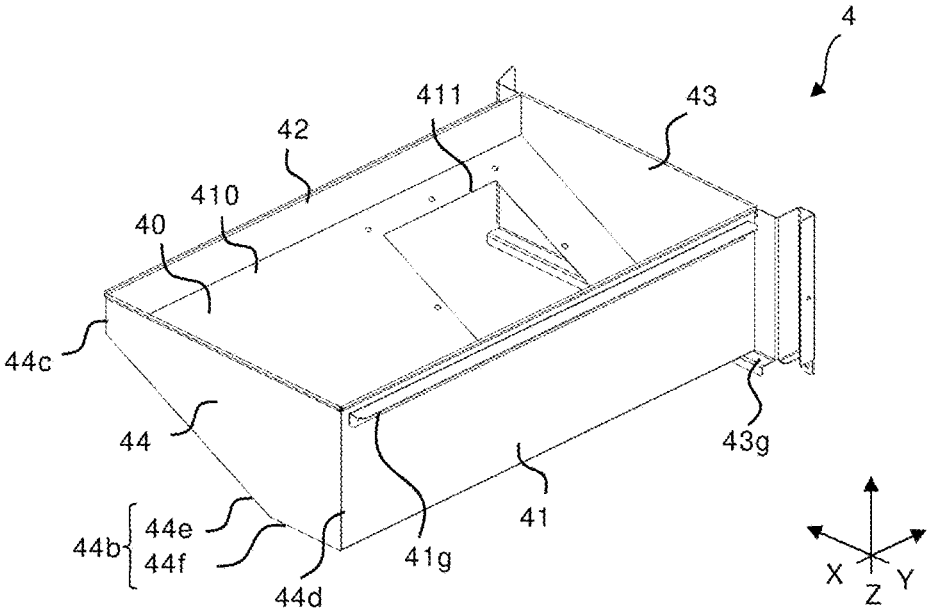
FIG. 13 is a perspective view of the appearance of the electric component box of the outdoor unit of the refrigeration cycle apparatus according to Embodiment when the left front of the electric component box is viewed from the top.
Figure 14:
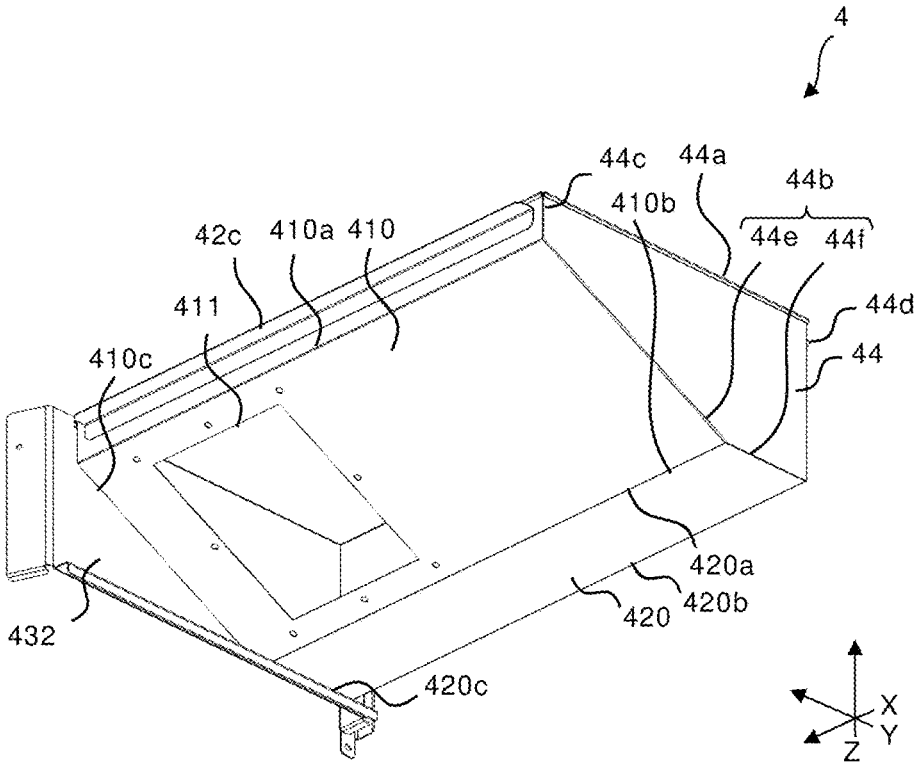
FIG. 14 is a perspective view of the appearance of the electric component box of the outdoor unit of the refrigeration cycle apparatus according to Embodiment when the left rear of the electric component box is viewed from the bottom.

FIG. 12 is a perspective view of the appearance of the electric component box 4 of the outdoor unit 100 of the refrigeration cycle apparatus according to Embodiment when the right front of the electric component box 4 is viewed from the top. FIG. 13 is a perspective view of the appearance of the electric component box 4 of the outdoor unit 100 of the refrigeration cycle apparatus according to Embodiment when the left front of the electric component box 4 is viewed from the top. FIG. 14 is a perspective view of the appearance of the electric component box 4 of the outdoor unit 100 of the refrigeration cycle apparatus according to Embodiment when the left rear of the electric component box 4 is viewed from the bottom.

As illustrated in FIG. 12, FIG. 13, and FIG. 14, the outer shell of the electric component box 4 includes the bottom plate 40, the front plate 41, the rear plate 42, the first side plate 43, and the second side plate 44. The front plate 41 and the rear plate 42 are parallel to each other and each disposed orthogonally to the first side plate 43 and the second side plate 44. The bottom plate 40 includes the inclined portion 410 and the horizontal portion 420.

The front plate 41 is continuous with the downstream end 420*b* of the horizontal portion 420 of the bottom plate 40. The front plate 41 extends upward from a lower end 41*b* continuous with the downstream end 420*b* of the horizontal portion 420 to an upper end 41*a*. In front view, the front plate 41 is positioned above the air outlet 104*a* of the front panel 104. Therefore, the airflow F inside the casing 100*a* is not obstructed.

A front support plate 41*g* extending forward from the front plate 41 is fixed to an upper part of the front plate 41. The front support plate 41*g* has a plurality of lid screw holes 45*a*. A lid 45 described later is attached to the front support plate 41*g*.

The rear plate 42 is continuous with the upstream end 410*a* of the inclined portion 410 of the bottom plate 40. The rear plate 42 is disposed parallel to the front plate 41. The rear plate 42 extends upward from a lower end 42*b* continuous with the upstream end 410*a* of the inclined portion 410 to an upper end 42*a*. A rear support plate 42*c* extending rearward from the rear plate 42 is fixed to an upper part of the rear plate 42. The rear support plate 42*c* has a plurality of lid screw holes 45*a*. The lid 45 described later is attached to the rear support plate 42*c*. The distance D1 described above is the shortest distance between the heat exchanger 3 and the rear plate 42 without including the rear support plate 42*c*.

The first side plate 43 serves as the side surface of the electric component box 4 that faces the machine chamber 101. As illustrated in FIG. 12, the first side plate 43 has a rectangular shape extending upward from a lower end 43*b* to an upper end 43*a*. The first side plate 43 is in contact with the rear plate 42 and the front plate 41.

As illustrated in FIG. 12 and FIG. 14, a right end 410*c* of the inclined portion 410 of the bottom plate 40 and a right end 420*c* of the horizontal portion 420 of the bottom plate 40 are connected to the first side plate 43 along a joint line L. The first side plate 43 is partitioned into a body region 431 and a protruding region 432 by the joint line L between the first side plate 43 and the bottom plate 40. The protruding region 432 protrudes downward beyond the inclined portion 410 at a boundary that is a part of the first side plate 43 in contact with the right end 410*c* of the inclined portion 410 of the bottom plate 40.

The first side plate 43 is attached such that the lower end 43*b* is in contact with the upper end of the partition plate 103. The first side plate 43 together with the partition plate 103 has a function of partitioning the machine chamber 101 and the air-sending device chamber 102. As illustrated in FIG. 13, the lower end 43*b* of the first side plate 43 is bent to have a horizontal surface 43*g*. The first side plate 43 is fixed with the horizontal surface 43*g* of the lower end 43*b* laid over the horizontal surface of the upper end of the partition plate 103. The lower end 43*b* of the first side plate 43 is attached in contact with the upper end of the partition plate 103, and the first side plate 43 and the partition plate 103 are arranged in the vertical direction but not in the lateral direction. Therefore, unnecessary plates can be omitted compared with a structure in which the machine chamber 101 and the air-sending device chamber 102 are partitioned by the partition plate 103 alone and the first side plate 43 is disposed in the air-sending device chamber 102 and side by side with the partition plate in the lateral direction. The first side plate 43 is joined to the partition plate 103 with, for example, screws. The first side plate 43 and the partition plate 103 may be arranged in the lateral direction.

As illustrated in FIG. 13 and FIG. 14, the second side plate 44 faces the first side plate 43. The second side plate 44 is disposed parallel to the first side plate 43. A lower end 44*b* of the second side plate 44 is continuous with the bottom plate 40. The lower end 44*b* includes an inclined end 44*e* continuous with the inclined portion 410 of the bottom plate 40, and a horizontal end 44*f* continuous with the horizontal portion 420 of the bottom plate 40. The inclined end 44*e* is inclined at the same gradient as that of the inclined portion 410. The horizontal end 44*f* horizontally extends at the same height position as that of the horizontal portion 420. The second side plate 44 extends upward from the lower end 44*b* to an upper end 44*a*. An upstream end 44*c* of the second side plate 44 is continuous with the rear plate 42, and a downstream end 44*d* of the second side plate 44 is continuous with the front plate 41.

<Structure of Mount Component>

Figure 15:
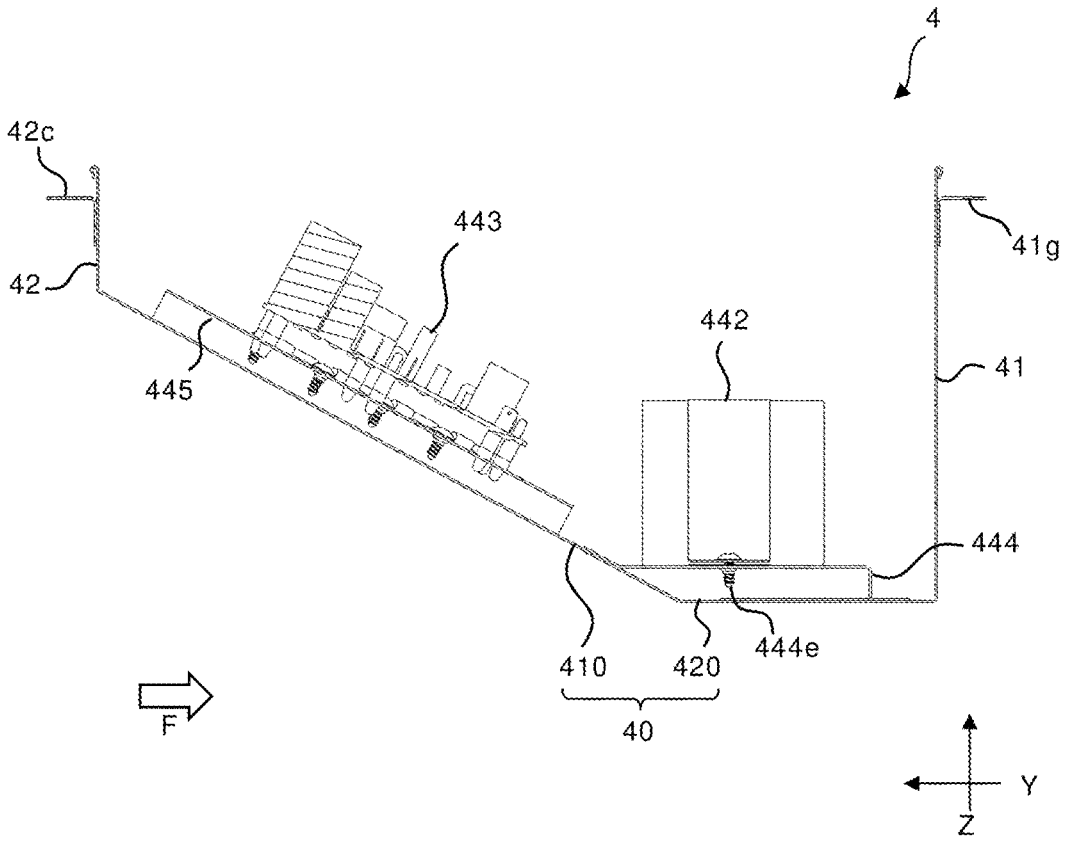
FIG. 15 illustrates the electric component box of the outdoor unit of the refrigeration cycle apparatus according to Embodiment.

FIG. 15 illustrates the electric component box 4 of the outdoor unit 100 of the refrigeration cycle apparatus according to Embodiment, and is a schematic diagram illustrating the inside of the electric component box 4 when a plane along the line CC in FIG. 11 is viewed in a +X direction. As illustrated in FIG. 15, the electric component 442 is placed on the mount component 444 and fixed to the horizontal portion 420.

Figure 16:
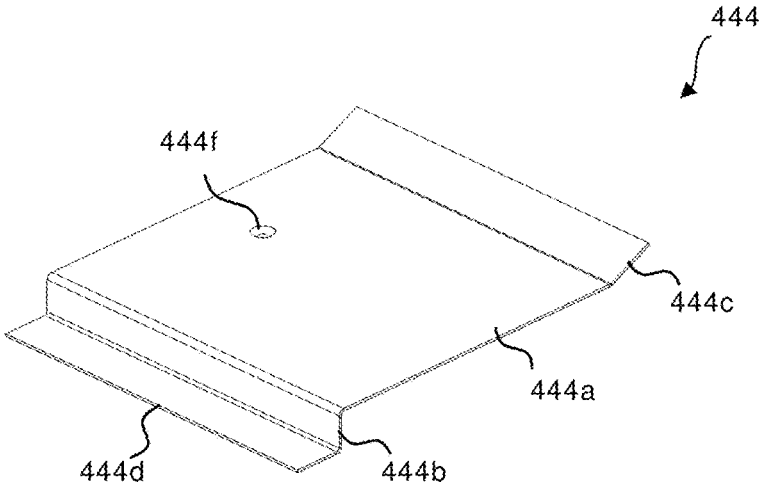
FIG. 16 is a perspective view of a mount component for use in the electric component box of the outdoor unit of the refrigeration cycle apparatus according to Embodiment.
Figure 17:
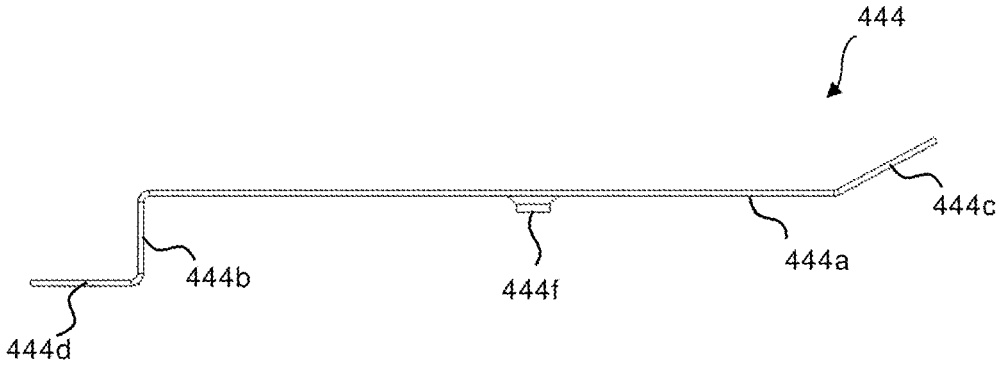
FIG. 17 is a side view of the mount component for use in the electric component box of the outdoor unit of the refrigeration cycle apparatus according to Embodiment.

FIG. 16 is a perspective view of the mount component 444 for use in the electric component box 4 of the outdoor unit 100 of the refrigeration cycle apparatus according to Embodiment. FIG. 17 is a side view of the mount component 444 for use in the electric component box 4 of the outdoor unit 100 of the refrigeration cycle apparatus according to Embodiment.

As illustrated in FIG. 16 and FIG. 17, the mount component 444 includes a mount plate 444*a* extending in a direction parallel to the horizontal portion 420, and a first attachment plate 444*b* and a second attachment plate 444*c* extending from the mount plate 444*a* and fixed to the bottom plate 40. The first attachment plate 444*b* and the second attachment plate 444*c* are examples of an attachment plate. The mount component 444 is made of a metal sheet.

The mount component 444 is fixed to the bottom plate 40 of the electric component box 4 by, for example, spot welding. For example, the mount component 444 is disposed over both the inclined portion 410 and the horizontal portion 420. That is, the first attachment plate 444*b* extends toward the horizontal portion 420 of the bottom plate 40 from the edge of the mount plate 444*a* on the downstream side of the airflow F.

The first attachment plate 444*b* has an L-shape in side view, and the lower end serves as a fixing plate 444*d*. The first attachment plate 444*b* is, for example, bent at a right angle. The first attachment plate 444*b* is fixed to the inner surface of the horizontal portion 420 by welding at the fixing plate 444*d*, which serves as a fixing portion. The second attachment plate 444*c* extends along the inclined portion 410 from the edge of the mount plate 444*a* on the upstream side of the airflow F. The second attachment plate 444*c* serves as a fixing portion, and is fixed to the inner surface of the inclined portion 410 by welding. When the mount component 444 is fixed to the bottom plate 40, the mount plate 444*a* is parallel to the horizontal portion 420.

Since the mount component 444 is fixed over both the inclined portion 410 and the horizontal portion 420, a horizontal part longer in the front-and-rear direction than the front-and-rear width of the horizontal portion 420 can be secured. Even when the electric component 442 has a dimension larger than the front-and-rear width of the horizontal portion 420, the electric component 442 can be disposed on the planar mount plate 444*a* parallel to the horizontal portion 420. In the present disclosure, the electric component 442 fixed to the mount component 444 fixed over both the inclined portion 410 and the horizontal portion 420 is included in the electric components 442 disposed on the horizontal portion 420.

The mount plate 444*a* has a mount plate screw hole 444*f*, and the electric component 442 is fixed with a mount screw 444*e*. The mount screw 444*e* passes through the mount plate screw hole 444*f* in the mount plate 444*a* toward the bottom plate 40 of the electric component box 4. The tip of the mount screw 444*e* is received in a space between the mount plate 444*a* to which the electric component 442 is fixed and the bottom plate 40 of the electric component box 4.

When the electric component 442 is directly fixed to the bottom plate 40 of the electric component box 4 with a screw, the screw passes through the bottom plate 40 of the electric component box 4 and an unsealed part is generated. Refrigerant gas having leaked flows into this part. The screw projecting to the outside of the electric component box 4 through the bottom plate 40 of the electric component box 4 impairs safety in attachment work for the electric component box 4. With the mount component 444 including the first attachment plate 444*b* and the second attachment plate 444*c*, a space is secured between the mount plate 444*a* to which the electric component 442 is fixed and the bottom plate 40 of the electric component box 4. Thus, the mount screw 444*e* passing through the mount plate 444*a* is prevented from projecting to the outside through the bottom plate 40 of the electric component box 4. It is thus prevent refrigerant gas having leaked from flowing in through the unsealed part and the safety in the attachment work for the electric component box 4 from being impaired.

(Modification 1 of Mount Component)

Figure 18:
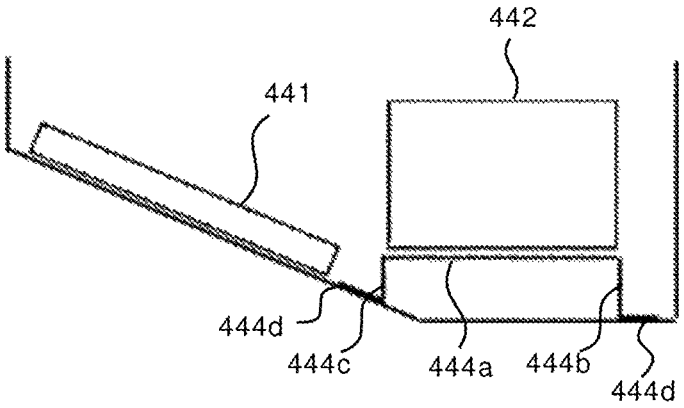
FIG. 18 is a schematic diagram of a mount component according to Modification 1 of the outdoor unit of the refrigeration cycle apparatus according to Embodiment.

FIG. 18 is a schematic diagram of a mount component 444 according to Modification 1 of the outdoor unit 100 of the refrigeration cycle apparatus according to Embodiment. As illustrated in FIG. 18, the second attachment plate 444*c* of the mount component 444 according to Modification 1 may extend toward the inclined portion 410 of the bottom plate 40 similarly to the first attachment plate 444*b* without extending along the inclined portion 410 of the bottom plate 40. In this case, the tip of the second attachment plate 444*c* is bent into a fixing plate 444*d*, but is bent at an acute angle instead of the right angle. The height of the mount component 444 (dimension in the vertical direction) can be adjusted by use of the length of the second attachment plate 444*c*. That is, the height of the space between the mount plate 444*a* and the bottom plate 40 of the electric component box 4 can be adjusted.

(Modification 2 of Mount Component)

Figure 19:
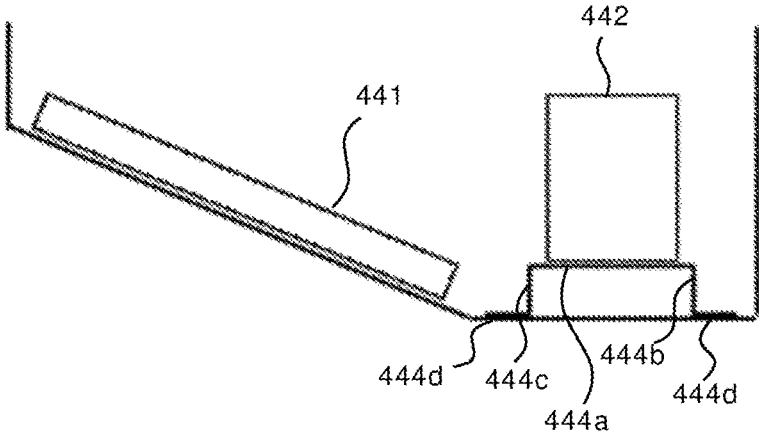
FIG. 19 is a schematic diagram of a mount component according to Modification 2 of the outdoor unit of the refrigeration cycle apparatus according to Embodiment.

FIG. 19 is a schematic diagram of a mount component 444 according to Modification 2 of the outdoor unit 100 of the refrigeration cycle apparatus according to Embodiment. As illustrated in FIG. 19, both the first attachment plate 444*b* and the second attachment plate 444*c* of the mount component 444 according to Modification 2 are disposed on the horizontal portion 420. That is, the second attachment plate 444*c* extends toward the horizontal portion 420 of the bottom plate 40 similarly to the first attachment plate 444*b* without extending along the inclined portion 410 of the bottom plate 40. The tip of the second attachment plate 444*c* is bent at the right angle into a fixing plate 444*d* similarly to the first attachment plate 444*b*.

The first attachment plate 444*b* and the second attachment plate 444*c* are provided at the edge of the mount plate 444*a* on the upstream side of the airflow F and the edge of the mount plate 444*a* on the downstream side of the airflow F, but may be provided at the edges in the lateral direction intersecting the airflow F. The first attachment plate 444*b* and the second attachment plate 444*c* may be provided at four sides of the mount plate 444*a*, that is, at the edges on the upstream side, on the downstream side, and in the lateral direction.

<Structure of Connection Component>

Figure 20:
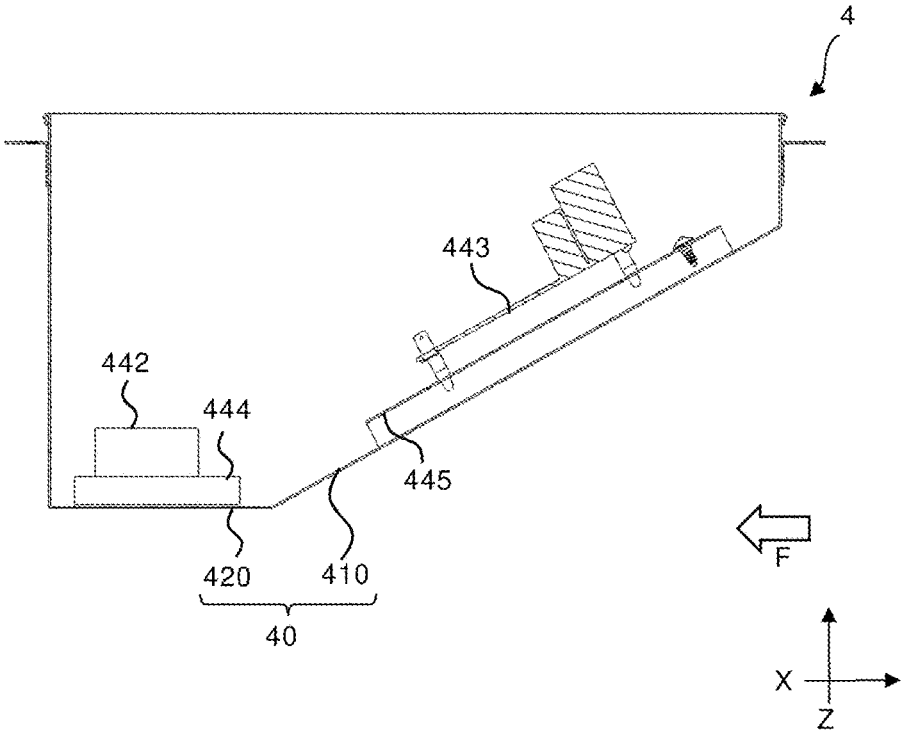
FIG. 20 illustrates the electric component box of the outdoor unit of the refrigeration cycle apparatus according to Embodiment.

FIG. 20 illustrates the electric component box 4 of the outdoor unit 100 of the refrigeration cycle apparatus according to Embodiment, and is a schematic diagram illustrating the inside of the electric component box 4 when a plane along the line DD in FIG. 11 is viewed in a −X direction.

As illustrated in FIG. 20, the electrical board 443 is placed on the connection component 445 and fixed to the inclined portion 410. The connection component 445 is fixed to the bottom plate 40 and projects to the inside of the electric component box 4 from the inner surface of the inclined portion 410 of the electric component box 4. The connection component 445 is made of a metal sheet. The connection component 445 has a structure similar to that of the mount component 444.

Figure 21:
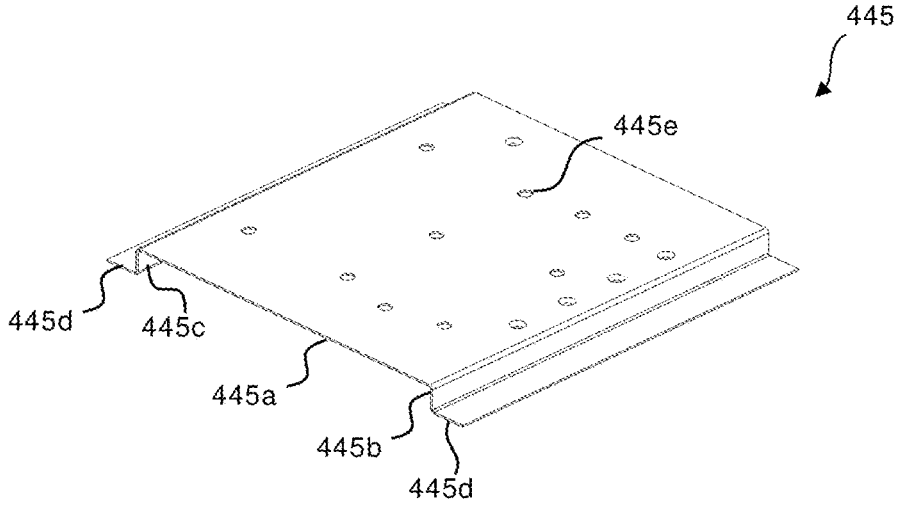
FIG. 21 is a perspective view of a connection component for use in the electric component box of the outdoor unit of the refrigeration cycle apparatus according to Embodiment.
Figure 22:
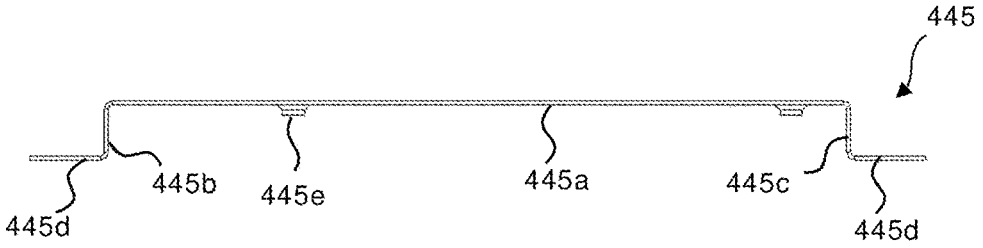
FIG. 22 is a side view of the connection component.
Figure 23:
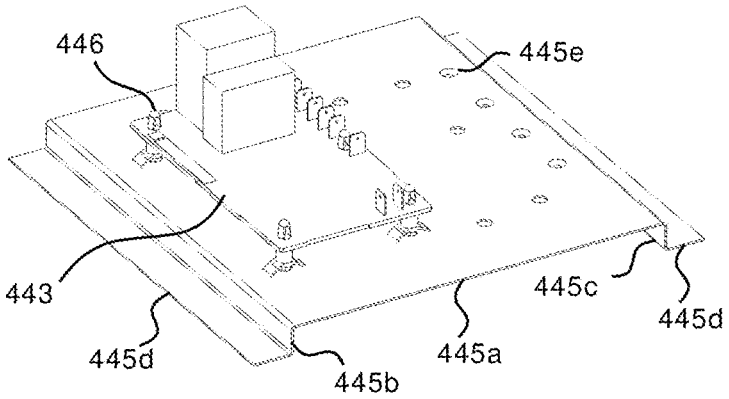
FIG. 23 is a perspective view illustrating the connection component on which the electrical board is mounted.
Figure 24:
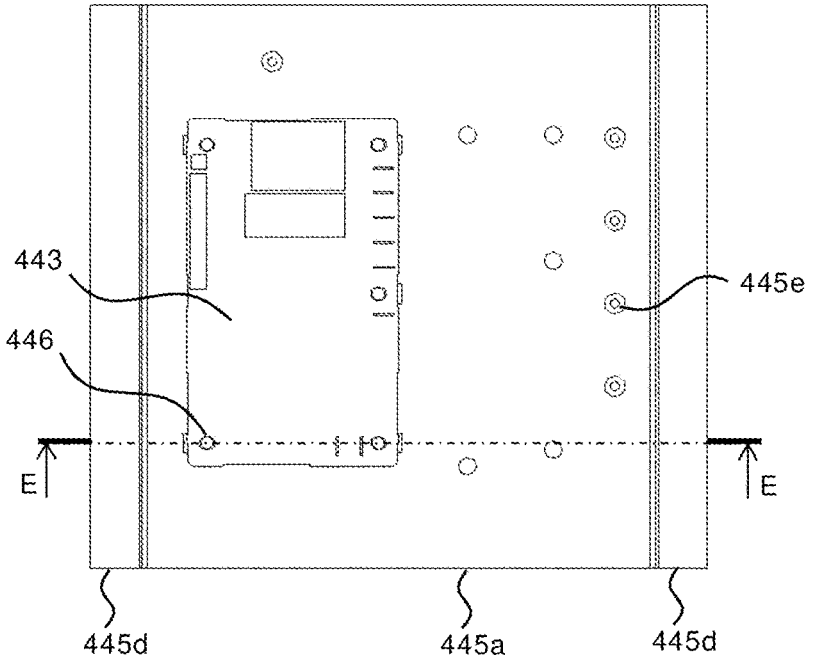
FIG. 24 is a top view illustrating the connection component on which the electrical board is mounted.
Figure 25:
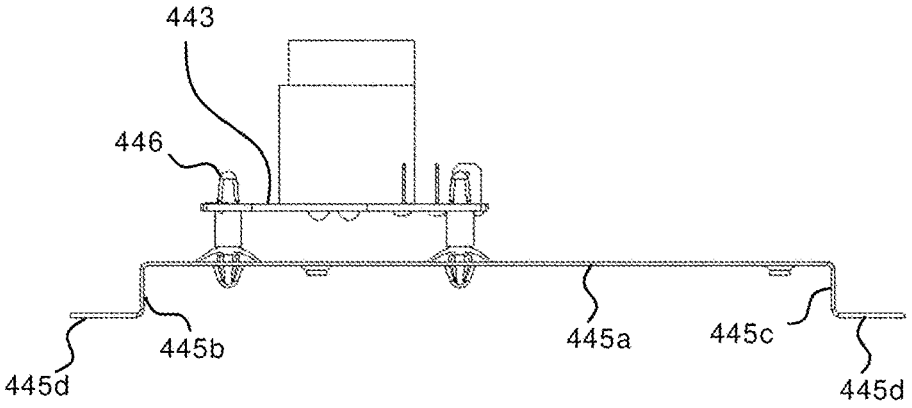
FIG. 25 is a side view illustrating the connection component on which the electrical board is mounted.
Figure 26:
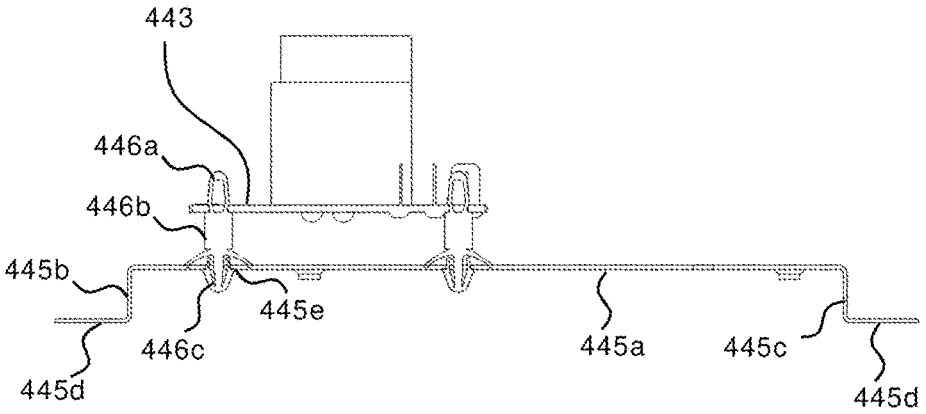
FIG. 26 is a schematic diagram illustrating the connection component on which the electrical board is mounted in the outdoor unit of the refrigeration cycle apparatus according to Embodiment.
Figure 27:
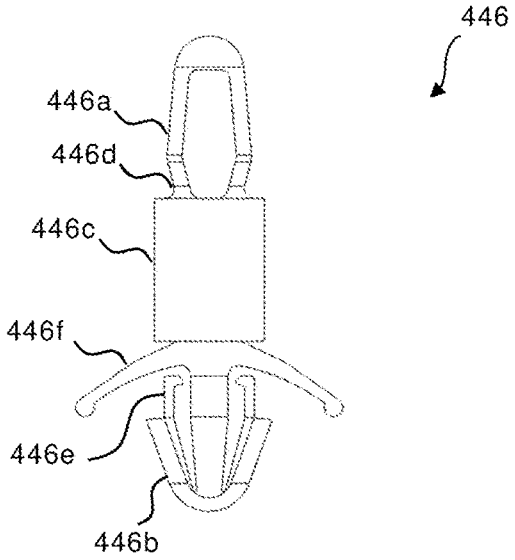
FIG. 27 is an enlarged view of a fixing part of the outdoor unit of the refrigeration cycle apparatus according to Embodiment.

FIG. 21 is a perspective view of the connection component 445 for use in the electric component box 4 of the outdoor unit 100 of the refrigeration cycle apparatus according to Embodiment. FIG. 22 is a side view of the connection component 445. FIG. 23 is a perspective view illustrating the connection component 445 on which the electrical board 443 is mounted. FIG. 24 is a top view illustrating the connection component 445 on which the electrical board 443 is mounted. FIG. 25 is a side view illustrating the connection component 445 on which the electrical board 443 is mounted. FIG. 26 is a schematic diagram illustrating the connection component 445 on which the electrical board 443 is mounted in the outdoor unit 100 of the refrigeration cycle apparatus according to Embodiment, and is a sectional view along the line EE in FIG. 24. FIG. 27 is an enlarged view of a fixing part 446 of the outdoor unit 100 of the refrigeration cycle apparatus according to Embodiment.

As illustrated in FIG. 21 to FIG. 27, the connection component 445 includes a connection plate 445*a* extending in a direction parallel to the bottom plate 40, a first leg 445*b*, and a second leg 445*c*. The first leg 445*b* and the second leg 445*c* extend from the connection plate 445*a* and are fixed to the bottom plate 40. The connection component 445 is disposed on the inclined portion 410. The connection component 445 is fixed to the bottom plate 40 of the electric component box 4 by, for example, spot welding. The first leg 445*b* is provided on the downstream side of the airflow F, and the second leg 445*c* is provided on the upstream side of the airflow F. For example, the electrical board 443 and the ground terminals 405 (see FIG. 11) are fixed to the connection component 445. The ground terminal 405 is connected to one end of a ground wire. The other end of the ground wire is connected to the control board 441.

The first leg 445*b* extends toward the inclined portion 410 of the bottom plate 40 from the edge of the connection plate 445*a* on the downstream side of the airflow F, and the tip is bent at a right angle into a fixing plate 445*d*. The second leg 445*c* extends toward the inclined portion 410 of the bottom plate 40 similarly to the first leg 445*b* from the edge of the connection plate 445*a* on the upstream side of the airflow F, and the tip is bent at a right angle into a fixing plate 445*d*. The fixing plates 445*d* of the first leg 445*b* and the second leg 445*c* are fixed to the inner surface of the inclined portion 410 by welding.

The connection plate 445*a* has a plurality of fixing holes 445*e*. The electrical board 443 is fixed to the connection plate 445*a*. The fixing parts 446 passing through the electrical board 443 are inserted into the fixing holes 445*e* to fix the electrical board 443 to the connection plate 445*a*. The ground terminals 405 may be fixed to the connection plate 445*a* by the fixing parts 446.

Since the connection component 445 includes the connection plate 445*a*, the first leg 445*b*, and the second leg 445*c*, the bottom plate 40 of the electric component box 4 does not have holes through which the electrical board 443 is fixed to the connection component 445. Therefore, the bottom plate 40 of the electric component box 4 does not have an unsealed part. Thus, refrigerant gas having leaked can be prevented from flowing into the electric component box 4.

The fixing part 446 is made of a resin. As illustrated in FIG. 27, the fixing part 446 includes a base portion 446*a* at one end, a fixing portion 446*b* at the other end, and a spacer 446*c* provided between the base portion 446*a* and the fixing portion 446*b*. The spacer 446*c* has a flare 446*f* shaped to flare out toward the fixing portion 446*b*. A first constriction 446*d* is provided between the base portion 446*a* and the spacer 446*c*. A second constriction 446*e* is provided between the spacer 446*c* and the fixing portion 446*b*. The first constriction 446*d* is thinner than the base portion 446*a* and the spacer 446*c*. The second constriction 446*e* is thinner than the spacer 446*c* and the fixing portion 446*b*.

The fixing part 446 is pushed into a through hole in the electrical board 443 and further into the fixing hole 445*e* in the connection plate 445*a*. At this time, the connection plate 445*a* is sandwiched between the lower end of the flare 446*f* of the spacer 446*c* and the fixing portion 446*b*, and the electrical board 443 is sandwiched between the base portion 446*a* and the spacer 446*c*. Thus, the electrical board 443 is fixed to the connection component 445 with a distance corresponding to the spacer 446*c* from the connection plate 445*a*. Since the electrical board 443 is supported by the connection component 445 such that the fixing part 446 molded from an insulating resin is interposed, the electrical board 443 is kept insulated from the connection component 445 made of the metal sheet and, furthermore, the electric component box 4 made of the metal sheet. The fixing portion 446*b* at the other end of the fixing part 446 is received in a space between the connection plate 445*a* and the inclined portion 410 of the electric component box 4.

It is sufficient that the ground terminals 405 be fixed to the mount component 444. The ground terminals 405 may be fixed to the mount component 444 with the mount screws 444*e* similarly to the electric component 442 fixed to the mount component 444. The ground terminals 405 may be fixed to the mount plate 444*a* of the mount component 444, or may be fixed to the first attachment plate 444*b* or the second attachment plate 444*c* of the mount component 444. In this case as well, a space is secured between the mount plate 444*a* and the bottom plate 40 of the electric component box 4. Therefore, it is possible to prevent refrigerant gas having leaked from flowing in through an unsealed part generated by the screw for fixation of the ground terminal 405, and the safety in the attachment work for the electric component box 4 from being impaired. The mount screw 444*e* is an example of a ground terminal screw.

<Attachment Structure for Control Board 441>

Figure 28:
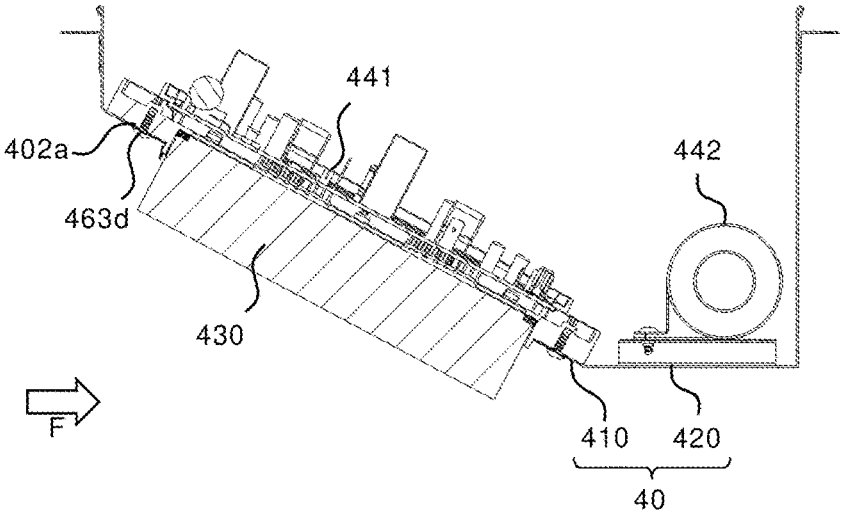
FIG. 28 illustrates the electric component box of the outdoor unit of the refrigeration cycle apparatus according to Embodiment.
Figure 29:
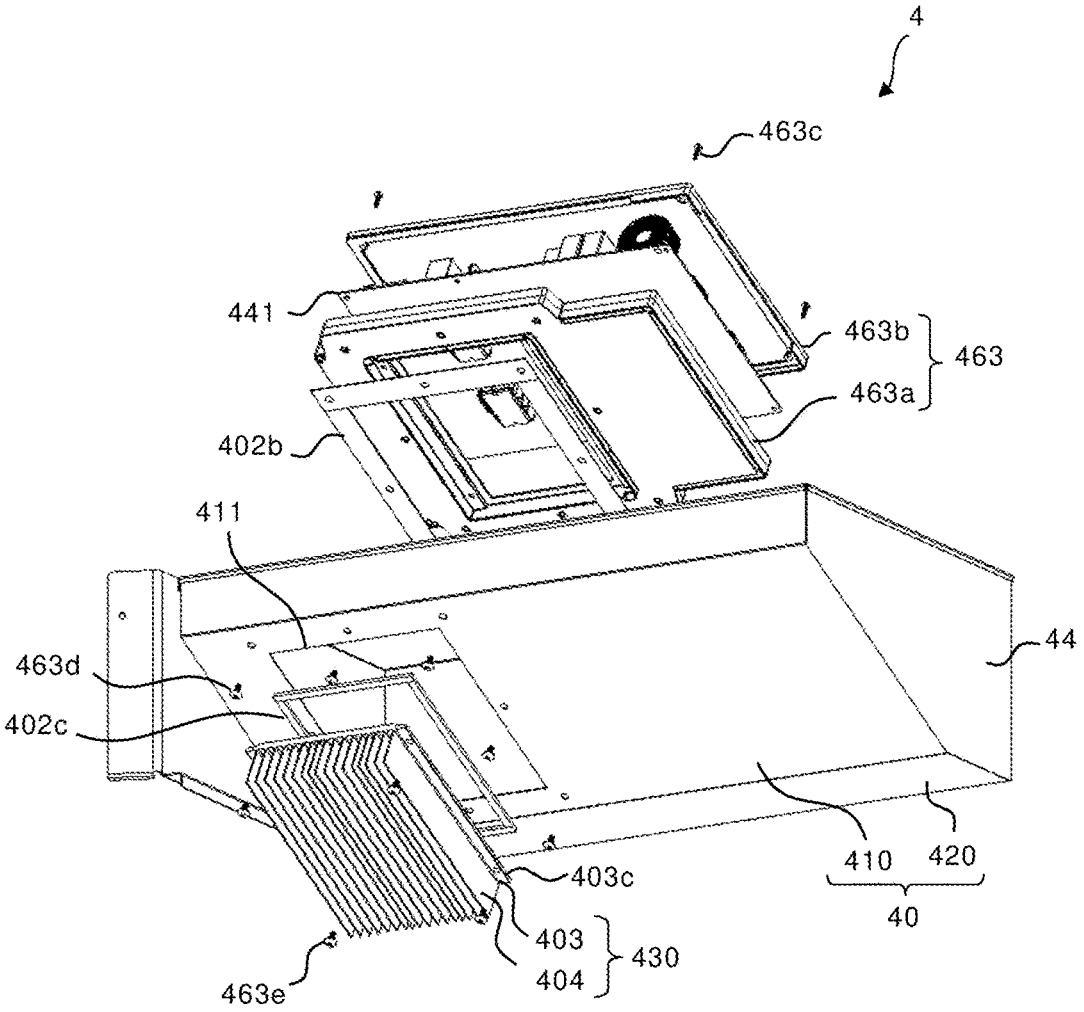
FIG. 29 is an exploded perspective view illustrating an attachment structure for a control board of the outdoor unit of the refrigeration cycle apparatus according to Embodiment.
Figure 30:
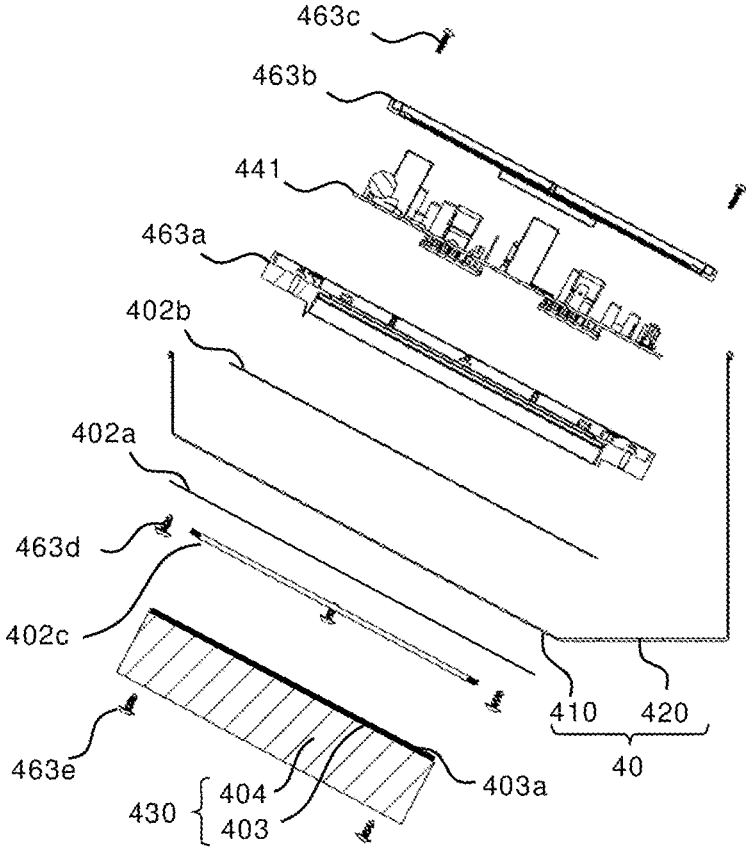
FIG. 30 is an exploded schematic sectional view of the electric component box of the outdoor unit of the refrigeration cycle apparatus according to Embodiment.

FIG. 28 illustrates the electric component box 4 of the outdoor unit 100 of the refrigeration cycle apparatus according to Embodiment, and is a schematic diagram when a plane along the line JJ in FIG. 11 is viewed in the +X direction. FIG. 29 is an exploded perspective view illustrating an attachment structure for the control board 441 of the outdoor unit 100 of the refrigeration cycle apparatus according to Embodiment. FIG. 30 is an exploded schematic sectional view of the electric component box 4 of the outdoor unit 100 of the refrigeration cycle apparatus according to Embodiment.

As illustrated in FIG. 28, FIG. 29, and FIG. 30, the control board 441 is disposed on the inclined portion 410 such that the control board 441 is held by a board case 463. The board case 463 includes a resin case 463*a* and a frame-shaped resin holder 463*b*. The control board 441 is held between the resin case 463*a* and the resin holder 463*b* such that the control board 441 is fitted to the resin case 463*a*. The resin holder 463*b* is fixed to the board case 463 with first screws 463*c*.

The board case 463 is fixed to the inner surface of the inclined portion 410 of the electric component box 4 with second screws 463*d*. The second screws 463*d* are attached from the outside of the electric component box 4 to the inside of the electric component box 4 and screwed into the resin case 463*a* through screw passing holes in the inclined portion 410.

A first surface 403*a* of the base plate 403 of the heat sink 430 is attached to the board case 463 with third screws 463*e* such the first surface 403*a* is in contact with a heat generating component of the control board 441. The first surface 403*a* of the base plate 403 is opposite to the surface where the plurality of fins 404 projects. When the board case 463 is fixed to the inclined portion 410 of the electric component box 4, the base plate 403 of the heat sink 430 closes the bottom opening 411 in the inclined portion 410 from the inside of the electric component box 4. When the board case 463 is fixed to the inclined portion 410 of the electric component box 4, the plurality of fins 404 of the heat sink 430 projects through the bottom opening 411. Since the heat sink 430 is fixed to the inclined portion 410, the airflow F is not obstructed and the heat sink 430 is efficiently cooled by the airflow F.

The electric component 442 and other devices housed in the electric component box 4 may be a cause of firing. Therefore, it is important to employ a structure in which, even when the refrigerant gas leaks, the refrigerant gas having leaked does not flow into the electric component box 4. Thus, a first sealer 402*a* is held between the second screws 463*d* and the inclined portion 410 of the bottom plate 40 of the electric component box 4. The second screw 463*d* is an example of a board case screw. A second sealer 402*b* is held between the inclined portion 410 of the bottom plate 40 of the electric component box 4 and the resin case 463*a* of the board case 463. With the first sealer 402*a* and the second sealer 402*b*, refrigerant gas having leaked is prevented from flowing into the electric component box 4 through the screw passing holes through which the second screws 463*d*, which fix the board case 463 to the inclined portion 410, pass.

Further, a third sealer 402*c* is held between the board case 463 and the heat sink 430. With the third sealer 402*c*, refrigerant gas having leaked is prevented from flowing through the bottom opening 411 from which the heat sink 430 projects.

The electric component box 4 houses the control board 441 and the electric component 442, which may be a cause of firing. In a case where flammable refrigerant gas is used, it is important to, when the refrigerant gas leaks, eliminate the possibility that the refrigerant gas having leaked flows into the electric component box 4. With the first sealer 402*a*, the second sealer 402*b*, and the third sealer 402*c* of the electric component box 4, it is possible to eliminate the possibility that refrigerant gas having leaked flows into the electric component box 4 through the bottom opening 411 or the screw passing holes in the inclined portion 410 through which the second screws 463*d* pass.

<Assembling Structure for Electric Component Box 4>

Figure 31:
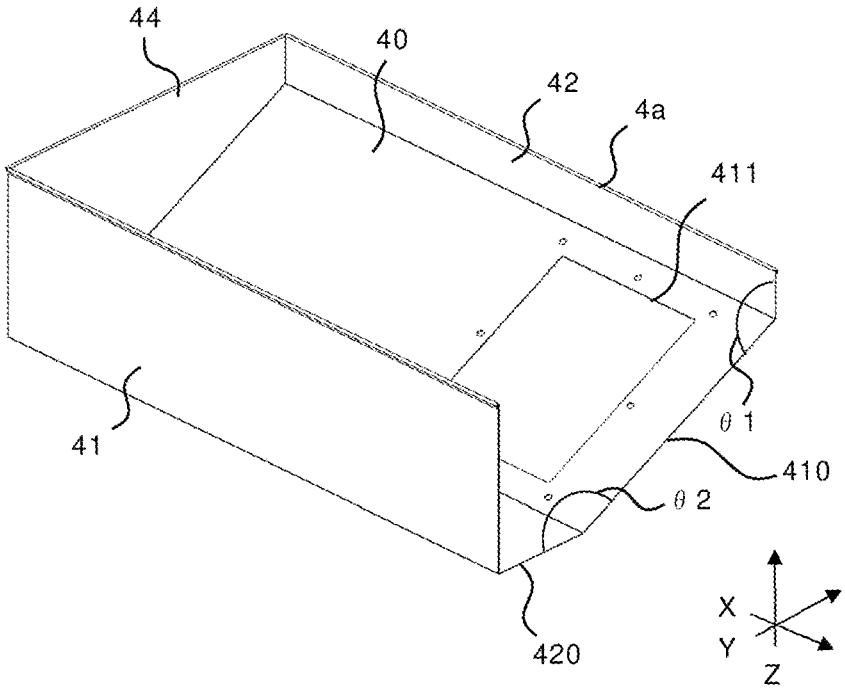
FIG. 31 is a perspective view of an assembling process for the electric component box of the outdoor unit of the refrigeration cycle apparatus according to Embodiment when the left front of the electric component box is viewed from the top.
Figure 32:
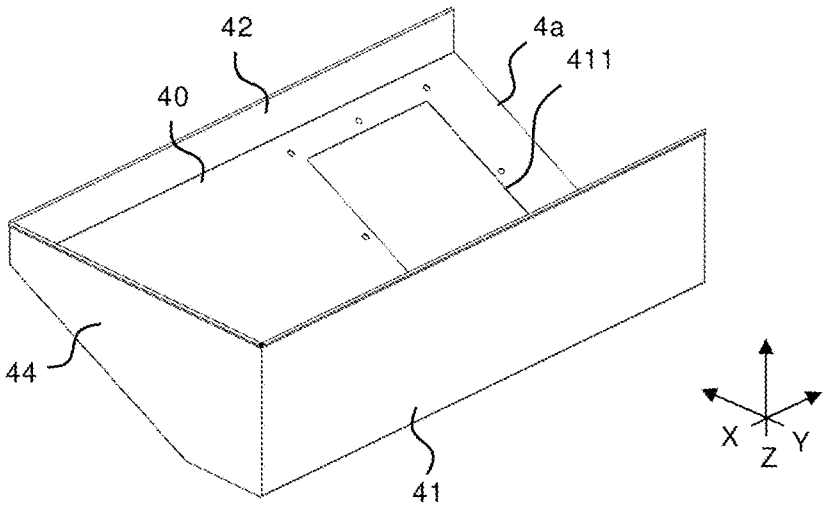
FIG. 32 is a perspective view of the assembling process for the electric component box of the outdoor unit of the refrigeration cycle apparatus according to Embodiment when the right front of the electric component box is viewed from the top.
Figure 33:
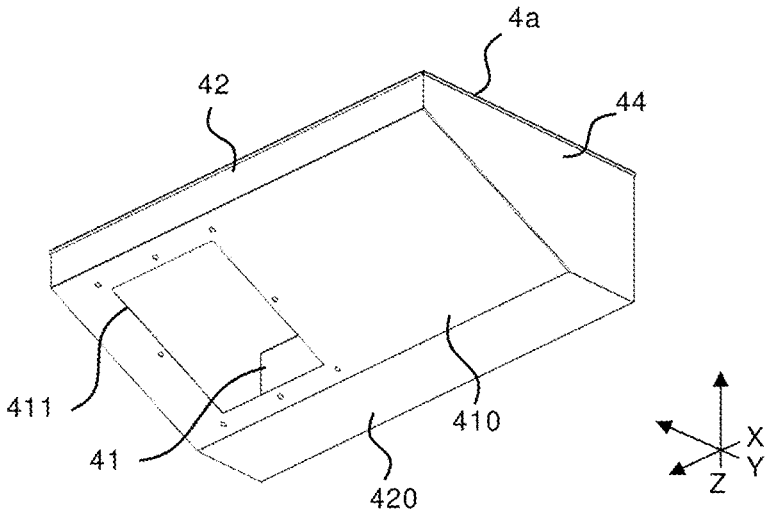
FIG. 33 is a perspective view of the assembling process for the electric component box of the outdoor unit of the refrigeration cycle apparatus according to Embodiment when the left rear of the electric component box is viewed from the bottom.
Figure 34:
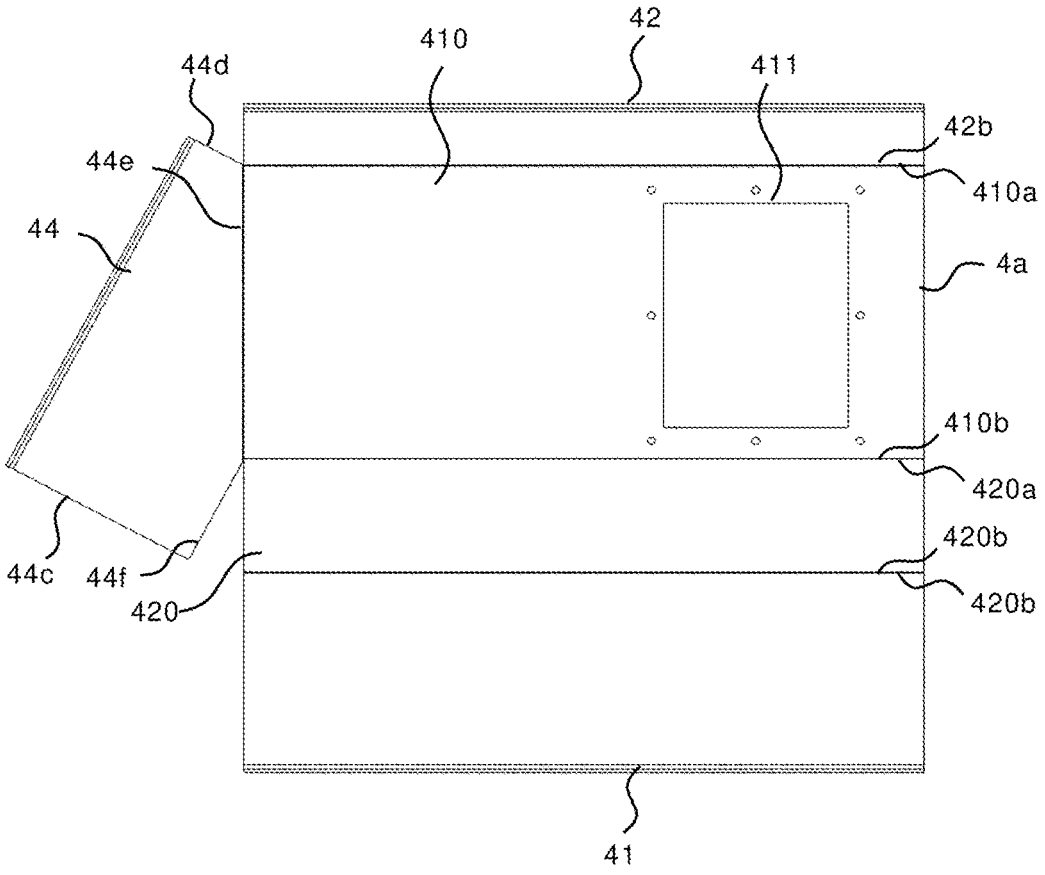
FIG. 34 is a developed view of the electric component box of the outdoor unit of the refrigeration cycle apparatus according to Embodiment.

FIG. 31 is a perspective view of an assembling process for the electric component box 4 of the outdoor unit 100 of the refrigeration cycle apparatus according to Embodiment when the left front of the electric component box 4 is viewed from the top. FIG. 32 is a perspective view of the assembling process for the electric component box 4 of the outdoor unit 100 of the refrigeration cycle apparatus according to Embodiment when the right front of the electric component box 4 is viewed from the top. FIG. 33 is a perspective view of the assembling process for the electric component box 4 of the outdoor unit 100 of the refrigeration cycle apparatus according to Embodiment when the left rear of the electric component box 4 is viewed from the bottom. FIG. 34 is a developed view of the electric component box 4 of the outdoor unit 100 of the refrigeration cycle apparatus according to Embodiment.

As illustrated in FIG. 31 to FIG. 34, the electric component box 4 is manufactured in such a manner that the first side plate 43 is joined to a box-shaped metal sheet component 4*a* including the bottom plate 40, the front plate 41, the rear plate 42, and the second side plate 44.

In the manufacture of the electric component box 4, a metal sheet having a predetermined shape including the bottom plate 40, the front plate 41, the rear plate 42, and the second side plate 44 is first cut. The bottom opening 411 is provided by punching. FIG. 34 illustrates the metal sheet cut into the predetermined shape. The cut metal sheet is bent at appropriate positions and the seams are welded such that the metal sheet is made into the box-shaped metal sheet component 4*a*.

Specifically, the metal sheet is bent at a bending position between the lower end 42*b* of the rear plate 42 and the upstream end 410*a* of the inclined portion 410 of the bottom plate 40 such that an angle θ1 between the rear plate 42 and the inclined portion 410 of the bottom plate 40 is an obtuse angle. The angle θ1 between the rear plate 42 and the inclined portion 410 of the bottom plate 40 is, for example, 120 degrees.

The downstream end 410*b* of the inclined portion 410 of the bottom plate 40 and the upstream end 420*a* of the horizontal portion 420 of the bottom plate 40 are connected to each other, the ends thus connected serve as a bending position, and the metal sheet is bent such that an angle θ2 between the horizontal portion 420 and the inclined portion 410 is an obtuse angle. The angle θ2 between the horizontal portion 420 and the inclined portion 410 is, for example, 150 degrees.

The downstream end 420*b* of the horizontal portion 420 of the bottom plate 40 and the lower end 41*b* of the front plate 41 are connected to each other, the ends thus connected serve as a bending position, and the metal sheet is bent such that the horizontal portion 420 of the bottom plate 40 and the front plate 41 have a right angle.

The lower inclined end 44*e* of the second side plate 44 is connected to the inclined portion 410, and the connection position serves as a bending position. The metal sheet is bent such that the second side plate 44 and the inclined portion 410 have a right angle.

The horizontal end 44*f* of the second side plate 44 is welded to the horizontal portion 420 of the bottom plate 40 over the total length. The upstream end 44*c* of the second side plate 44 is welded to the rear plate 42 over the total length. The downstream end 44*d* of the second side plate 44 is welded to the front plate 41 over the total length. Thus, the box-shaped metal sheet component 4*a* is obtained.

The electric component box 4 is formed in such a manner that the first side plate 43 is welded to the metal sheet component 4*a* including the bottom plate 40, the front plate 41, the rear plate 42, and the second side plate 44. The first side plate 43 is welded continuously to the front plate 41, the bottom plate 40, and the rear plate 42 over their total lengths. Many corners of the electric component box 4 are defined by bending the metal sheet and therefore the number of welded portions is reduced. Thus, when the welding is insufficient, the risk of inflow of refrigerant gas having leaked into the electric component box 4 through an insufficiently welded portion is reduced.

The second side plate 44 may be provided separately similarly to the first side plate 43. In this case, the inclined end 44*e* of the second side plate 44 is not connected to the inclined portion 410, and is welded to the inclined portion 410 over the total length.

Figure 35:
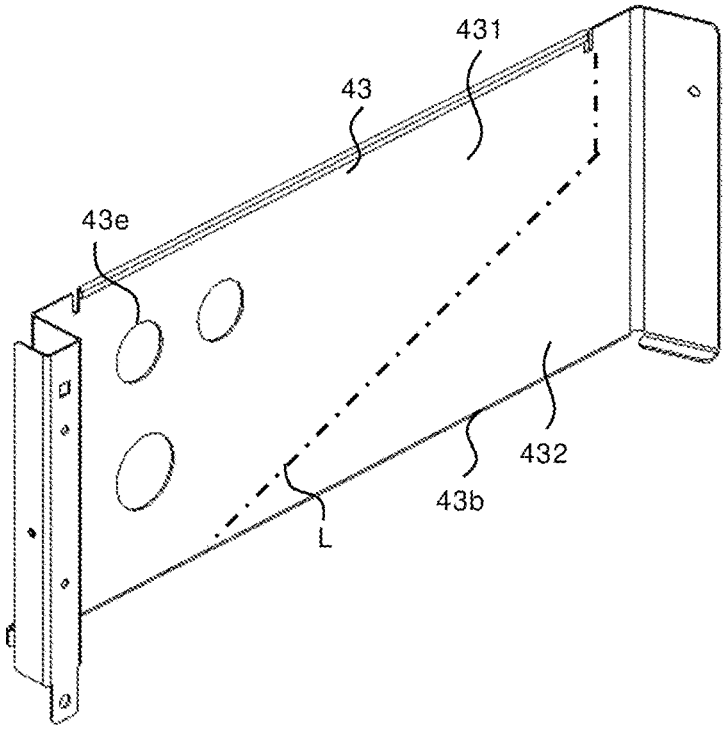
FIG. 35 is a perspective view of a first side plate of the electric component box of the outdoor unit of the refrigeration cycle apparatus according to Embodiment when the first side plate is viewed from the outside of the electric component box.
Figure 36:
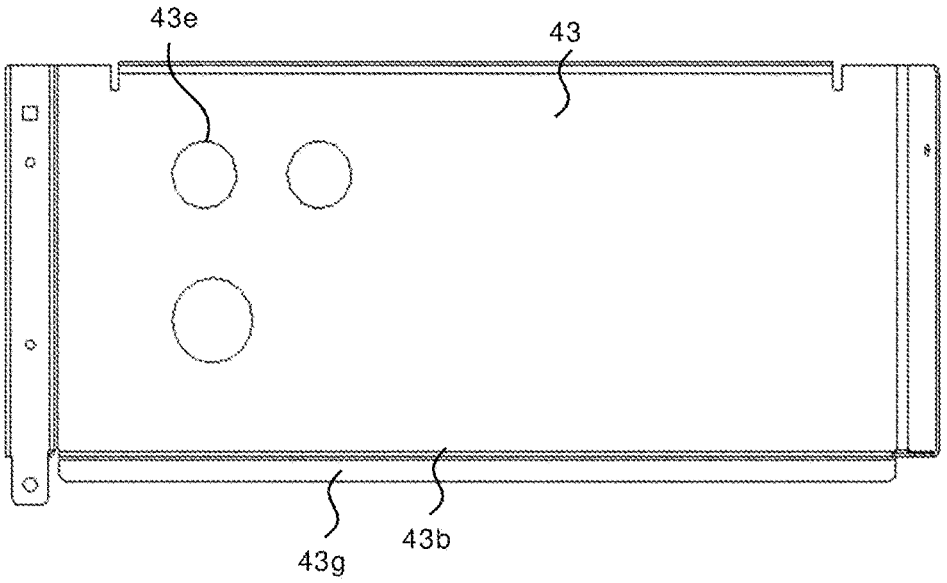
FIG. 36 is a side view of the first side plate.

FIG. 35 is a perspective view of the first side plate 43 of the electric component box 4 of the outdoor unit 100 of the refrigeration cycle apparatus according to Embodiment when the first side plate 43 is viewed from the outside of the electric component box 4. FIG. 36 is a side view of the first side plate 43.

The first side plate 43 is made of a metal sheet. As illustrated in FIG. 35 and FIG. 36, the first side plate 43 has a rectangular shape including the body region 431 and the protruding region 432. In FIG. 35, the body region 431 is higher than the joint line L, and the protruding region 432 is lower than the joint line L. The first side plate 43 has a plurality of electric wire passing ports 43*e*.

The lower end 43*b* of the first side plate 43 has the horizontal surface 43*g* bent in the horizontal direction. The horizontal surface 43*g* is laid over the horizontal surface of the upper end of the partition plate 103.

The first side plate 43 is attached to the metal sheet component 4*a* and therefore the electric component box 4 is manufactured. Specifically, the first side plate 43 is welded to the right end 410*c* of the inclined portion 410 of the bottom plate 40 and the right end 420*c* of the horizontal portion 420 of the bottom plate 40 along the joint line L over the total lengths. The first side plate 43 is welded to the rear plate 42 on the upstream side of the airflow F and to the front plate 41 on the downstream side of the airflow F over the total lengths.

It is desirable that the outer surface of the electric component box 4 made of the metal sheet be subjected to resin coating. At this time, the electric component box 4 is subjected to resin coating such that the welded portions are covered. The inner surface of the electric component box 4 may also be subjected to resin coating, but it is sufficient that at least the outer surface be subjected to resin coating.

During the operation of the refrigeration cycle apparatus, air having passed through the heat exchanger 3 flows along the outer surface of the inclined portion 410 of the electric component box 4 in the air-sending device chamber 102. In a coastal region or other regions, the electric component box 4 positioned in the air-sending device chamber 102 and made of the metal sheet is susceptible to salt damage. Through the resin coating performed as surface treatment for the electric component box 4 disposed in the upper part of the air-sending device chamber 102, corrosion of the electric component box 4 due to the salt damage can be prevented. In the coastal region with a strong possibility of salt damage, it is effective to perform the resin coating for the outer surface of the electric component box 4.

<Structure of Electric Wire Passing Ports 43*e*>

Figure 37:
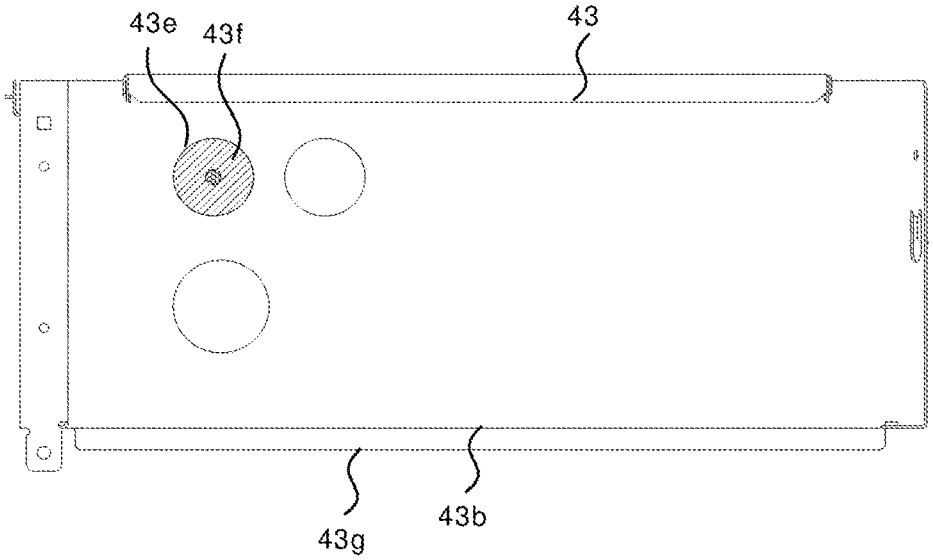
FIG. 37 is a side view illustrating the first side plate of the electric component box of the outdoor unit of the refrigeration cycle apparatus according to Embodiment.
Figure 38:
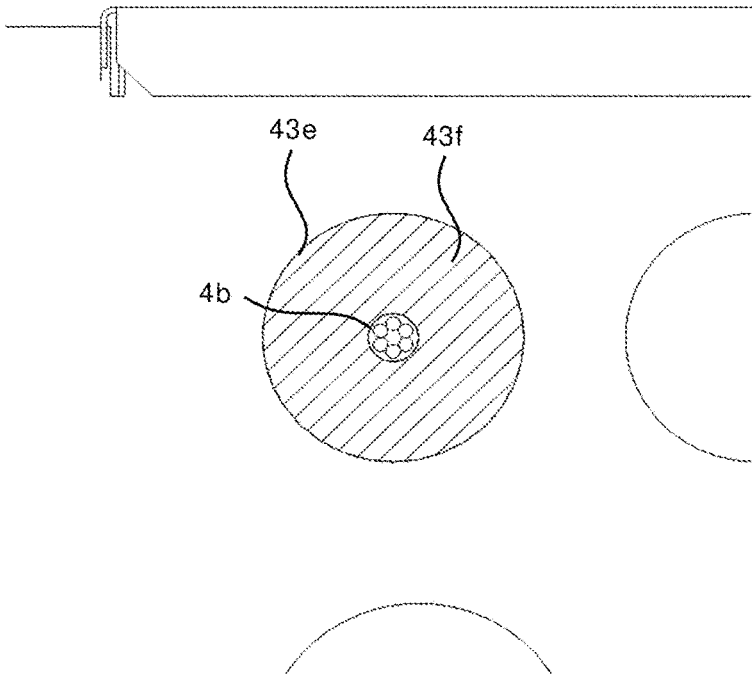
FIG. 38 is an enlarged view of an electric wire passing port in the first side plate.

FIG. 37 is a side view illustrating the first side plate 43 of the electric component box 4 of the outdoor unit 100 of the refrigeration cycle apparatus according to Embodiment. FIG. 38 is an enlarged view of the electric wire passing ports 43*e* in the first side plate 43.

As illustrated in FIG. 37 and FIG. 38, the first side plate 43 has the electric wire passing ports 43*e*. The electric wire passing port 43*e* is filled with a sealer 43*f*. The electric wire passing port 43*e* is a hole for passage of the electric wire 4*b* extending from the electric component 442, the control board 441, or the electrical board 443 in the electric component box 4 to the machine chamber 101. The sealer 43*f* is an elastically deformable part, and seals a region other than the electric wire 4*b* by being elastically deformed. The sealer 43*f* is made of, for example, rubber.

The electric wire 4*b* is connected to, for example, the compressor 1 or another constituent element such as the unillustrated expansion valve. The sealer 43*f* seals the region of the electric wire passing port 43*e* other than the electric wire 4*b*. Even when the refrigerant gas leaks in the machine chamber 101, the refrigerant gas having leaked is prevented from flowing into the electric component box 4 through the electric wire passing port 43*e*.

In a case where the first side plate 43 also has the function of the partition plate 103, it is sufficient that the electric wire passing port 43*e* be provided in the first side plate 43 alone, and the electric wire passing port 43*e* does not have to be provided in both the electric component box 4 and the partition plate 103. Therefore, the wiring workability is improved.

<Structure of Lid>

Figure 39:
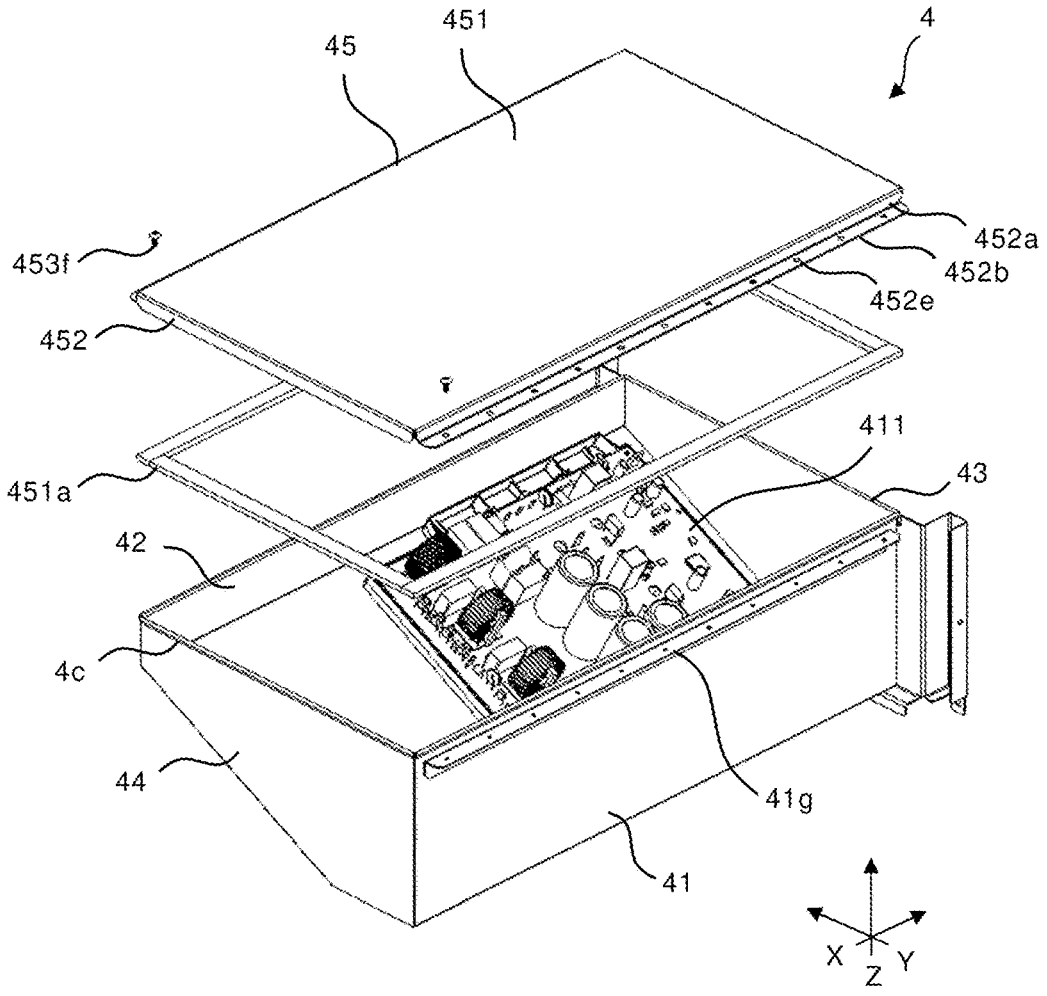
FIG. 39 is an exploded perspective view of the electric component box of the outdoor unit of the refrigeration cycle apparatus according to Embodiment.
Figure 40:
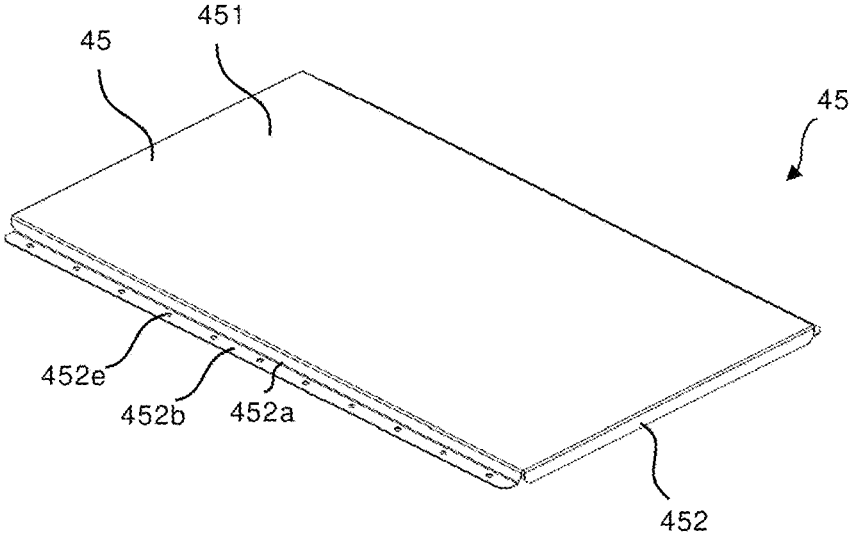
FIG. 40 is a perspective view of a lid of the electric component box of the outdoor unit of the refrigeration cycle apparatus according to Embodiment when the lid is viewed obliquely from the top.
Figure 41:
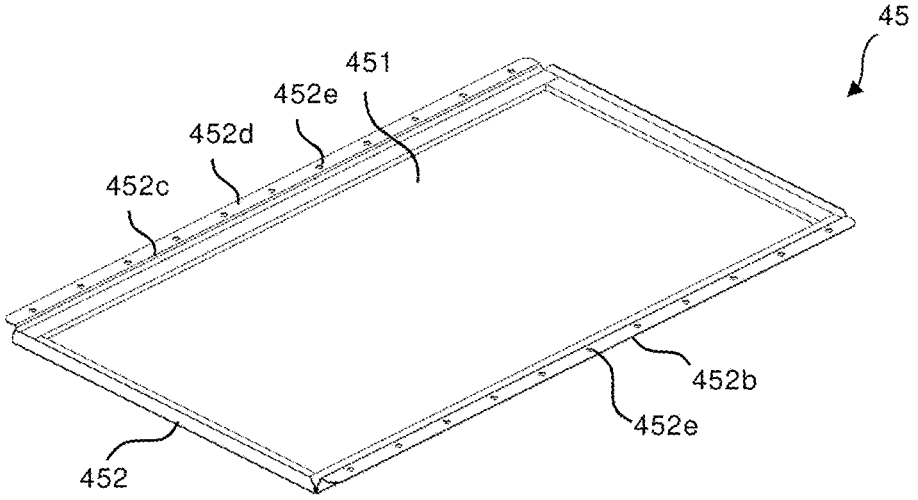
FIG. 41 is a perspective view of the lid of the electric component box of the outdoor unit of the refrigeration cycle apparatus according to Embodiment when the lid is viewed obliquely from the bottom.
Figure 42:
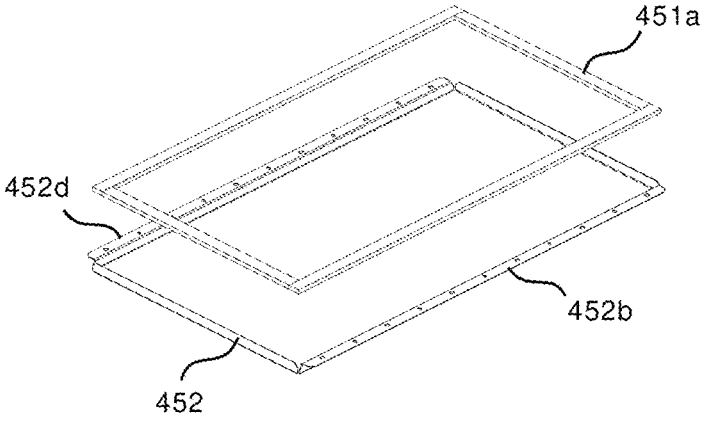
FIG. 42 is an exploded perspective view of the lid of the electric component box of the outdoor unit of the refrigeration cycle apparatus according to Embodiment.

FIG. 39 is an exploded perspective view of the electric component box 4 of the outdoor unit 100 of the refrigeration cycle apparatus according to Embodiment. FIG. 40 is a perspective view of the lid 45 of the electric component box 4 of the outdoor unit 100 of the refrigeration cycle apparatus according to Embodiment when the lid 45 is viewed obliquely from the top. FIG. 41 is a perspective view of the lid 45 of the electric component box 4 of the outdoor unit 100 of the refrigeration cycle apparatus according to Embodiment when the lid 45 is viewed obliquely from the bottom. FIG. 42 is an exploded perspective view of the lid 45 of the electric component box 4 of the outdoor unit 100 of the refrigeration cycle apparatus according to Embodiment.

As illustrated in FIG. 39 to FIG. 42, the top of the electric component box 4 is hermetically closed by being covered with the lid 45. The lid 45 is a rectangular part that covers the internal space of the electric component box 4 from the top. The lid 45 includes a lid plate 451 and a frame plate 452.

The lid plate 451 is disposed parallel to the horizontal portion 420 of the bottom plate 40. The lid plate 451 has a rectangular shape larger than a rectangular shape defined by the front plate 41, the rear plate 42, the first side plate 43, and the second side plate 44 serving as outer peripheral walls of the electric component box 4. A lid sealer 451*a* is held between the lid plate 451 and the upper ends of the outer peripheral walls of the electric component box 4.

The lid sealer 451*a* has the same shape as the rectangular shape defined by the upper ends of the front plate 41, the rear plate 42, the first side plate 43, and the second side plate 44 serving as the outer peripheral walls of the electric component box 4. The lid sealer 451*a* is held by the lid plate 451 such that the lid sealer 451*a* is placed on a sealer receiving surface 4*c* defined by the upper ends of the front plate 41, the rear plate 42, the first side plate 43, and the second side plate 44 of the electric component box 4. The sealer receiving surface 4*c* is defined in such a manner that the upper ends of the front plate 41, the rear plate 42, the first side plate 43, and the second side plate 44 are bent to the inside of the electric component box 4. Therefore, the lid sealer 451*a* is held between the lower surface of the lid plate 451 and the sealer receiving surface 4*c* at all of the four sides of the electric component box 4, and the lid 45 and the outer peripheral walls of the electric component box 4 are sealed over the entire periphery.

The frame plate 452 extends downward from the outer periphery of the lid plate 451 to have a right angle with the lid plate 451, and is disposed such that the frame plate 452 covers the tops of the outer peripheral walls of the electric component box 4. The frame plate 452 is disposed such that the frame plate 452 faces the upper parts of the front plate 41, the rear plate 42, the first side plate 43, and the second side plate 44. The frame plate 452 surrounds the upper parts of the front plate 41, the rear plate 42, the first side plate 43, and the second side plate 44. Therefore, horizontal movement of the lid 45 is restricted.

As illustrated in FIG. 40 and FIG. 41, a front frame plate 452*a* of the frame plate 452, which faces the front plate 41, has a front fixing plate 452*b* bent at a right angle from the lower end of the front frame plate 452*a* and extending away from the front plate 41. A rear frame plate 452*c* of the frame plate 452, which faces the rear plate 42, has a rear fixing plate 452*d* bent at a right angle from the lower end of the rear frame plate 452*c* and extending away from the rear plate 42.

The front fixing plate 452*b* and the rear fixing plate 452*d* have a plurality of lid screw passing holes 452*e* along their longitudinal directions. For example, the plurality of lid screw passing holes 452*e* is arranged at regular intervals. The lid screw passing holes 452*e* in the front fixing plate 452*b* are positioned in alignment with the lid screw holes 45*a* in the front support plate 41*g* of the electric component box 4. The lid screw passing holes 452*e* in the rear fixing plate 452*d* are positioned in alignment with the lid screw holes 45*a* in the rear support plate 42*c* of the electric component box 4.

The front fixing plate 452*b* of the lid 45 is disposed such that the front fixing plate 452*b* is laid over the front support plate 41*g* of the electric component box 4. The front fixing plate 452*b* is fixed to the front support plate 41*g* in such a manner that lid screws 453*f* passing through the lid screw passing holes 452*e* in the front fixing plate 452*b* are screwed into the lid screw holes 45*a* in the front support plate 41*g*.

Similarly, the rear fixing plate 452*d* of the lid 45 is fixed to the rear support plate 42*c* in such a manner that the lid screws 453*f* are screwed into the lid screw holes 45*a* in the rear support plate 42*c*.

It is sufficient that the front fixing plate 452*b* have a width enough to be coupled to the front support plate 41*g* extending from the front plate 41. Similarly, it is sufficient that the rear fixing plate 452*d* have a width enough to be coupled to the rear support plate 42*c* extending from the rear plate 42. The lid 45 is fixed to the electric component box 4 in such a manner that the front fixing plate 452*b* of the lid 45 is disposed such that the front fixing plate 452*b* is laid over the front support plate 41*g*, the rear fixing plate 452*d* is disposed such that the rear fixing plate 452*d* is laid over the rear support plate 42*c*, and the front fixing plate 452*b* and the rear fixing plate 452*d* are fixed with the lid screws 453*f*.

For example, a self-tapping screw is used as the lid screw 453*f*, which fixes the lid 45. The self-tapping screw is a screw to be screwed into a target material having a pilot hole instead of an internally threaded target material. The self-tapping screw is screwed and thus plastically deforms the hole in the target material to form an internal thread. It is sufficient that the hole in the target material be a flanged hole, or be simply a through hole when the target material is thick. The lid screw holes 45*a* in the front support plate 41*g* and the rear support plate 42*c* are flanged holes, and the lid screws 453*f*, which are self-tapping screws, are screwed to form internal threads.

The top panel 108 of the casing 100*a* may be used as a lid that covers the internal space of the electric component box 4 from the top. In this case, the lid 45 can be omitted and therefore the number of components can be reduced.

<Fixation of Electric Component Box 4>

Figure 43:
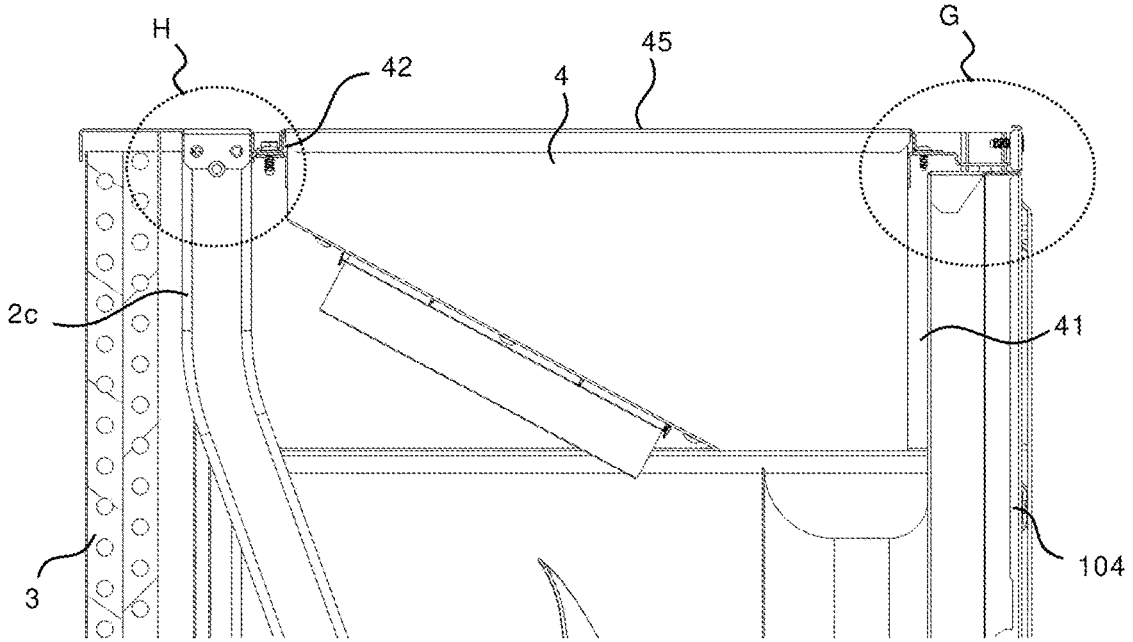
FIG. 43 is a schematic side view illustrating a fixing structure for the electric component box of the outdoor unit of the refrigeration cycle apparatus according to Embodiment.
Figure 44:
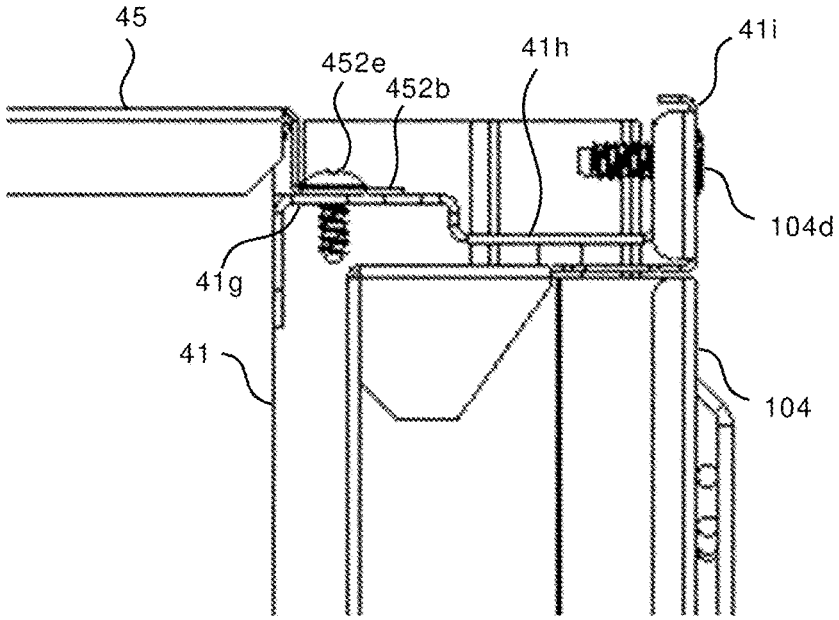
FIG. 44 is a schematic side view illustrating fixation of a front side of the electric component box.
Figure 45:
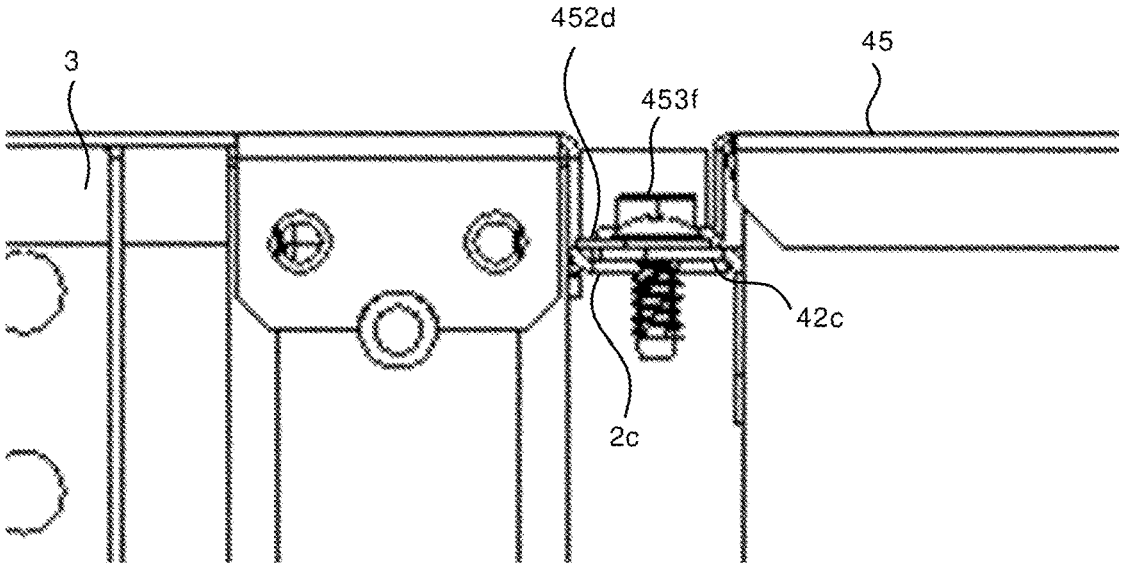
FIG. 45 is a schematic side view illustrating fixation of a rear side of the electric component box.

FIG. 43 is a schematic side view illustrating a fixing structure for the electric component box 4 of the outdoor unit 100 of the refrigeration cycle apparatus according to Embodiment. FIG. 44 is a schematic side view illustrating fixation of the front side of the electric component box 4, and is an enlarged view of the dotted circle G in FIG. 43. FIG. 45 is a schematic side view illustrating fixation of the rear side of the electric component box 4, and is an enlarged view of the dotted circle H in FIG. 43.

As illustrated in FIG. 43, FIG. 44, and FIG. 45, the electric component box 4 is fixed in the space between the propeller fan 2*a* in the air-sending device chamber 102 and the top panel 108 in such a manner that the front support plate 41*g* of the front plate 41 is attached to the front panel 104 and the rear support plate 42*c* of the rear plate 42 is attached to the motor support 2*c*. A front fixing piece 41*h* projecting forward is provided at a part of the front support plate 41*g* to which the front fixing plate 452*b* of the lid 45 is fixed. The tip of the front fixing piece 41*h* is a front fixing portion 41*i* bent upward, and the front fixing portion 41*i* has a fixing screw hole. The front fixing piece 41*h* is provided at a part of the front support plate 41*g* in the longitudinal direction and, in this case, is provided at the center of the electric component box 4 in the lateral direction.

The electric component box 4 is fixed to the front panel 104 in such a manner that the front fixing portion 41*i* is disposed along the inner surface of the front panel 104 and a panel fixing screw 104*d* passing through a screw passing hole in the front panel 104 is screwed into the fixing screw hole in the front fixing portion 41*i*. The head of the panel fixing screw 104*d* is positioned on the outside of the front panel 104, but a folded piece at the outer peripheral edge of the top panel 108 is positioned on the outside of the head of the panel fixing screw 104*d* so that the head of the panel fixing screw 104*d* is not exposed.

A part of the rear support plate 42*c* to which the rear fixing plate 452*d* of the lid 45 is fixed is sandwiched between the rear fixing plate 452*d* of the lid 45 and the upper end of the motor support 2*c*. At this part, the rear fixing plate 452*d* of the lid 45 and the rear support plate 42*c* are fastened together to the upper end of the motor support 2*c* with the lid screw 453*f*. Thus, the electric component box 4 is fixed to the motor support 2*c*.

The rear support plate 42*c* has the plurality of lid screw holes 45*a*. At the part of the rear support plate 42*c* that is sandwiched between the rear fixing plate 452*d* and the upper end of the motor support 2*c*, a screw passing hole having a larger bore diameter than the lid screw hole 45*a* and simply passing through the rear support plate 42*c* is provided instead of the lid screw hole 45*a*.

<Structure of Top Panel>

Figure 46:
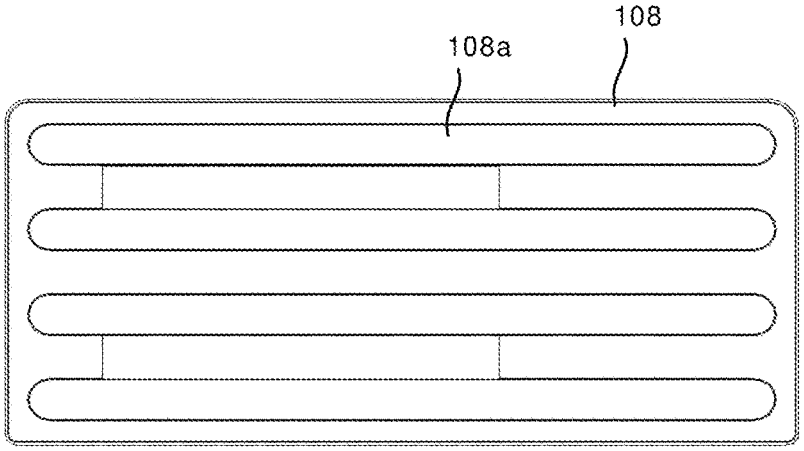
FIG. 46 is a plan view of a top panel of the outdoor unit of the refrigeration cycle apparatus according to Embodiment.
Figure 47:
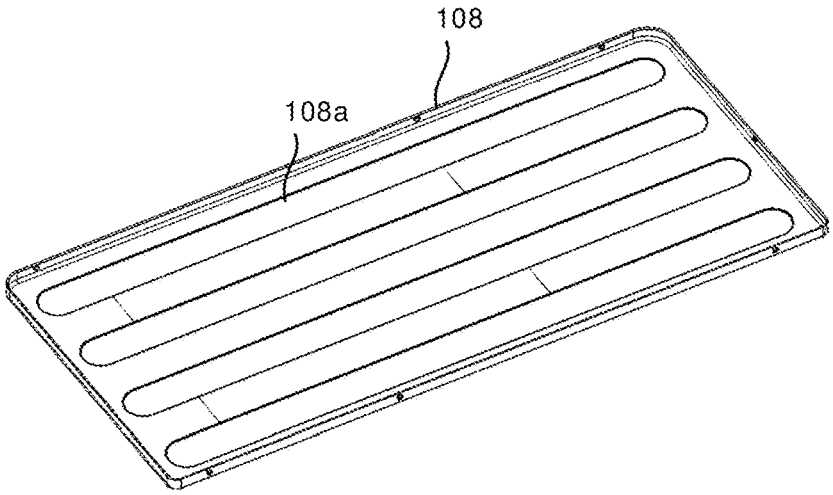
FIG. 47 is a perspective view of the top panel when the top panel is viewed from the inside.

FIG. 46 is a plan view of the top panel 108 of the outdoor unit 100 of the refrigeration cycle apparatus according to Embodiment. FIG. 47 is a perspective view of the top panel 108 when the top panel 108 is viewed from the inside.

As illustrated in FIG. 46 and FIG. 47, cushions 108*a* are bonded to the inner surface of the top panel 108. The cushions 108*a* may be bonded to the outer surface of the lid 45 of the electric component box 4. The cushions 108*a* are interposed between the top panel 108 made of the metal sheet and the lid 45 of the electric component box 4 made of the metal sheet to prevent contact between the top panel 108 and the lid 45 and to close a gap between the top panel 108 and the lid 45, thereby preventing air having passed through the heat exchanger 3 from flowing between the top panel 108 and the lid 45.

It is appropriate that a plurality of band-shaped cushions 108*a* be provided along the long side of the rectangular top panel 108 and one or more cushions 108*a* be in contact with the lid 45 such that the one or more cushions 108*a* are disposed over the lid 45 in the lateral direction. It is preferable that the cushions 108*a* be in contact with the end of the lid 45 on the upstream side of the airflow F. The cushions 108*a* may have band shapes and may be disposed along the four edges of the lid 45 in a rectangular shape in plan view. The cushions 108*a* close the gap between the top panel 108 and the lid 45 of the electric component box 4.

With the cushions 108*a* closing the gap between the top panel 108 and the lid 45 of the electric component box 4, air sucked into the air-sending device chamber 102 and passing through the heat exchanger 3 does not flow through the gap. Therefore, the volume of air flowing along the inclined portion 410 of the electric component box 4 is increased, and the cooling effect for the heat sink 430 and the bottom plate 40 is improved.

As described above, in the outdoor unit 100 of the refrigeration cycle apparatus according to Embodiment, the bottom plate 40 of the electric component box 4 includes the inclined portion 410 of which the upstream side in the airflow F is positioned above the downstream side in the airflow F, and the horizontal portion 420 extending in the horizontal direction from the downstream side of the inclined portion 410. Therefore, the electric component box 4 having an increased area for disposition of the housed control components can be disposed above the air-sending device 2 without the increase in the vertical height of the projection area of the electric component box 4 in the plane orthogonal to the airflow F.

The plurality of fins 404 of the heat sink 430 projects through the bottom opening 411 in the inclined portion 410. Therefore, a sufficient volume of air can be obtained for cooling of the heat sink 430.

The plurality of fins 404 is arranged side by side in the direction orthogonal to the airflow F and parallel to the lateral direction of the casing 100*a*. Therefore, the cooling efficiency of the heat sink 430 is improved.

The first sealer 402*a* is held between the second screws 463*d* passing through the board case 463 and the bottom plate 40, and the second sealer 402*b* is held between the board case 463 and the bottom plate 40. Further, the third sealer 402*c* is held between the board case 463 and the base plate 403 of the heat sink 430. Even when the refrigerant leaks and the refrigerant having leaked flows into the air-sending device chamber 102, the refrigerant gas having leaked is prevented from flowing into the electric component box 4 through the bottom opening 411 from which the heat sink 430 projects, and is prevented from flowing into the electric component box 4 through the screw passing holes of the second screws 463*d*, which fix the board case 463 through the bottom plate 40.

The electric component box 4 is disposed at the distance larger than or equal to the distance D1 from the heat exchanger 3 in top view. Therefore, the electric component box 4 does not obstruct the passage of the airflow F through the upper part of the heat exchanger 3, which faces the electric component box 4. Thus, the air passes also through the upper part of the heat exchanger 3. The electric component box 4 disposed in the upper part of the air-sending device chamber 102 does not cause a decrease in the heat exchange capacity of the heat exchanger 3.

The mount component 444 including the mount plate 444*a* and the first attachment plate 444*b* and the second attachment plate 444*c* extending from the mount plate 444*a* and fixed to the bottom plate 40 of the electric component box 4 is fixed to the bottom plate 40. A space is secured between the mount plate 444*a* and the bottom plate 40. When the electric component 442 is fixed onto the mount plate 444*a* with the mount screw 444*e*, the tip of the mount screw 444*e* does not project to the outside from the bottom plate 40 of the electric component box 4. Therefore, there is no unsealed part that may be generated by a projecting screw and may be a part through which refrigerant gas having leaked flows in. Further, the safety is maintained in the attachment work for the electric component box 4.

The mount component 444 is fixed over both the inclined portion 410 and the horizontal portion 420. Therefore, a planar part longer in the front-and-rear direction than the front-and-rear width of the horizontal portion 420 can be secured. Even the electric component 442 having a front-and-rear dimension larger than the front-and-rear width of the horizontal portion 420 can be disposed on the mount plate 444*a* parallel to the horizontal portion 420.

The mount component 444 is fixed to the horizontal portion 420, and the tip of the mount screw 444*e*, which fixes the electric component 442, is received between the mount plate 444*a* and the horizontal portion 420. Therefore, the tip of the mount screw 444*e*, which fixes the electric component 442 or the ground terminal 405, does not project to the outside from the bottom plate 40 of the electric component box 4.

The connection component 445 is fixed to the inclined portion 410 of the electric component box 4, and the ground terminals 405 are fixed to the connection component 445 with screws. Therefore, the tips of the screws do not project to the outside from the bottom plate 40 of the electric component box 4. Thus, there is no unsealed part that may be generated by a projecting screw and may be a part through which refrigerant gas having leaked flows in. Further, the safety is maintained in the attachment work for the electric component box 4.

The connection component 445 includes the connection plate 445*a*, and the first leg 445*b* and the second leg 445*c* extending from the connection plate 445*a*. Therefore, a space is secured between the connection plate 445*a* and the bottom plate 40. Therefore, when the electric component 442, the electrical board 443, or the ground terminal 405 is fixed to the connection component 445 with a screw, the tip of the screw does not project to the outside from the bottom plate 40 of the electric component box 4.

The tip of the fixing part 446, which fixes the electrical board 443, is received in the space between the connection plate 445*a* and the bottom plate 40 of the electric component box 4. Therefore, the electrical board 443 can be fixed onto the connection plate 445*a* of the connection component 445 with the fixing part 446 made of a resin in such a manner that the fixing part 446 is inserted into the fixing hole 445*e* in the connection component 445. Thus, the electrical board 443 can be kept insulated from the connection component 445 and the electric component box 4 made of the metal sheets.

The lower end of the rectangular first side plate 43 serving as the side wall of the electric component box 4, which is positioned such that the side wall faces the machine chamber, is in contact with the upper end of the partition plate 103. The first side plate 43 can function to partition the upper part of the machine chamber 101 and the upper part of the air-sending device chamber 102. Therefore, the amount of use of the plate can be reduced and the resources can be saved compared with the case where only the partition plate 103 partitions the machine chamber 101 and the air-sending device chamber 102 and the partition plate 103 and the first side plate 43 are arranged in the lateral direction.

The first side plate 43 has the electric wire passing port 43*e* for passage of the electric wire 4*b* connecting the device disposed in the machine chamber 101 and the control board 441, the electrical board 443, or the electric component 442 in the electric component box 4. Since the first side plate 43 partitions the upper part of the machine chamber 101 and the upper part of the air-sending device chamber 102, the electric wire 4*b* simply passes through the electric wire passing port 43*e* in the first side plate 43, and does not have to further pass through the partition plate 103. Thus, the wiring workability for a worker is improved.

The sealer 43*f* is provided in the electric wire passing port 43*e*. Even when the refrigerant leaks in the machine chamber 101, the refrigerant gas having leaked is prevented from flowing into the electric component box 4 through the electric wire passing port 43*e*.

The lid sealer 451*a* is held between the lower surface of the lid plate 451 of the lid 45 and the sealer receiving surface 4*c* provided at the upper ends of the outer peripheral walls of the electric component box 4. Therefore, the lid 45 and the outer peripheral walls of the electric component box 4 are sealed over the entire periphery.

The invention claimed is:

1. An outdoor unit for a refrigeration cycle apparatus, comprising:

a casing that is an outer shell;

an air-sending device housed in the casing and configured to generate an airflow; and an electric component box housed in the casing, disposed above the air-sending device, and including a bottom plate on which control components are placed, the bottom plate of the electric component box including an inclined portion on which a first component among the control components is fixed, the inclined portion being inclined such that an upstream end of the inclined portion on an upstream side of the airflow is positioned above a downstream end of the inclined portion on a downstream side of the airflow, and a horizontal portion on which a second component among the control components is fixed, the horizontal portion horizontally extending to the downstream side of the airflow and having an upstream end on the upstream side of the airflow that is connected to the downstream end of the inclined portion on the downstream side of the airflow.

2. The outdoor unit for the refrigeration cycle apparatus of claim 1, further comprising a heat exchanger disposed on the upstream side of the airflow in the casing, wherein a distance at which the airflow is not obstructed is secured between the electric component box and the heat exchanger in top view.

3. The outdoor unit for the refrigeration cycle apparatus of claim 1, further comprising a lid that covers the electric component box from a top, wherein the lid includes a lid plate facing the bottom plate, and wherein a lid sealer is held between the lid plate and a sealer receiving surface at an upper end of the electric component box.

4. The outdoor unit for the refrigeration cycle apparatus of claim 1, wherein a connection component is fixed to an inner surface of the inclined portion of the electric component box, wherein a ground terminal attached to one end of a ground wire connected to the first component at an other end is fixed to the connection component, wherein the connection component includes a connection plate that is flat-shaped and to which the ground terminal is fixed, and a leg extending toward the bottom plate from an end of the connection plate, and wherein a tip of the leg is fixed to the inclined portion by welding.

5. The outdoor unit for the refrigeration cycle apparatus of claim 4, wherein the second component is fixed with a fixing part made of a resin and inserted into a fixing hole in the connection component.

6. The outdoor unit for the refrigeration cycle apparatus of claim 1, wherein the electric component box further includes a front plate, a rear plate facing the front plate, a first side plate disposed in a direction intersecting the front plate and the rear plate, and a second side plate facing the first side plate, the front plate, the rear plate, the first side plate, and the second side plate being connected to the bottom plate and serving as outer peripheral walls of the electric component box, wherein the first side plate has a rectangular shape with a protruding region projecting downward beyond a part in contact with the inclined portion of the bottom plate, wherein a lower end of the first side plate is in contact with an upper end of a partition plate extending upward from a bottom surface of the casing, and wherein an inside of the casing is partitioned by the first side plate and the partition plate into an air-sending device chamber in which the electric component box is disposed and a machine chamber in which a compressor is disposed.

7. The outdoor unit for the refrigeration cycle apparatus of claim 6, wherein the first side plate has an electric wire passing port for passage of an electric wire guided to an inside of the machine chamber from an inside of the electric component box.

8. The outdoor unit for the refrigeration cycle apparatus of claim 7, wherein a sealer that is elastically deformed and thus seals a region other than the electric wire is provided in the electric wire passing port.

9. The outdoor unit for the refrigeration cycle apparatus of claim 1, wherein a mount component to which the second component is fixed with a mount screw is fixed to an inner surface of the bottom plate of the electric component box, wherein the mount component includes a mount plate that is flat-shaped and through which the mount screw passes, and an attachment plate extending toward the bottom plate from an end of the mount plate, and wherein a lower end of the attachment plate is fixed to the bottom plate by welding.

10. The outdoor unit for the refrigeration cycle apparatus of claim 9, wherein the attachment plate includes a first attachment plate extending toward the horizontal portion from the mount plate and fixed to the horizontal portion, and a second attachment plate positioned further upstream in the airflow than the first attachment plate and fixed to the inclined portion, and wherein the mount plate is fixed over both the horizontal portion and the inclined portion, or fixed to the horizontal portion, and disposed parallel to the horizontal portion.

11. The outdoor unit for the refrigeration cycle apparatus of claim 9, wherein a tip of the mount screw that fixes the second component is received in a space between the mount plate and the bottom plate.

12. The outdoor unit for the refrigeration cycle apparatus of claim 1, wherein the first component is a control board, and wherein the second component is at least one of an electric component or an electrical board.

13. The outdoor unit for the refrigeration cycle apparatus of claim 12, wherein the inclined portion has a bottom opening, and wherein a plurality of fins of a heat sink configured to cool the first component projects through the bottom opening.

14. The outdoor unit for the refrigeration cycle apparatus of claim 13, wherein the plurality of fins is arranged side by side in a direction orthogonal to the airflow.

15. The outdoor unit for the refrigeration cycle apparatus of claim 13, further comprising a board case that holds the control board, wherein the board case is fixed to the inclined portion of the bottom plate of the electric component box with a board case screw passing through the inclined portion of the bottom plate of the electric component box from an outside of the electric component box, wherein a base plate of the heat sink in contact with the control board is fixed to the board case, wherein a first sealer is held between the board case screw and the inclined portion, wherein a second sealer is held between the board case and the inclined portion, and wherein a third sealer is held between the board case and the base plate.

* * * * *